US006962213B2

(12) United States Patent
Hartwick

(10) Patent No.: US 6,962,213 B2
(45) Date of Patent: Nov. 8, 2005

(54) SLEEVE PISTON FLUID MOTOR

(76) Inventor: Patrick W. Hartwick, 7123 Emerald Glen Dr., Sugar Land, TX (US) 77479-6273

( * ) Notice: Subject to any disclaimer, the term of this patent is extended or adjusted under 35 U.S.C. 154(b) by 0 days.

(21) Appl. No.: 10/782,682

(22) Filed: Feb. 19, 2004

(65) Prior Publication Data

US 2004/0245019 A1 Dec. 9, 2004

Related U.S. Application Data

(60) Provisional application No. 60/448,559, filed on Feb. 19, 2003.

(51) Int. Cl.[7] ..... E21B 4/04; F03C 2/08
(52) U.S. Cl. ..... 175/57; 175/107; 418/104
(58) Field of Search ..... 175/107, 57; 418/104, 418/206.9, 1

(56) References Cited

U.S. PATENT DOCUMENTS

| | | | | |
|---|---|---|---|---|
| 3,088,529 | A | 5/1963 | Cullen et al. | |
| 3,838,953 | A | 10/1974 | Peterson | |
| 3,876,350 | A | 4/1975 | Warder | |
| 4,040,494 | A | 8/1977 | Keliner | |
| 4,105,377 | A | 8/1978 | Mayall | |
| 4,286,676 | A | 9/1981 | Nguyen | |
| 4,374,547 | A | 2/1983 | Nguyen et al. | |
| 4,462,472 | A | 7/1984 | Beimgraben | |
| 4,641,717 | A | 2/1987 | Eppink | |
| 4,882,979 | A * | 11/1989 | Weyer | 92/33 |
| 5,305,837 | A | 4/1994 | Johns | |
| 5,314,030 | A | 5/1994 | Peterson | |
| 5,452,772 | A | 9/1995 | Van Den Bergh | |
| 5,518,379 | A | 5/1996 | Harris et al. | |
| 5,785,509 | A | 7/1998 | Harris et al. | |
| 5,803,187 | A | 9/1998 | Javins | |
| 5,833,444 | A | 11/1998 | Harris et al. | |
| RE36,166 | E | 3/1999 | Johns | |
| 6,050,346 | A | 4/2000 | Hipp | |
| 6,179,574 | B1 * | 1/2001 | Yie | 417/269 |
| 6,290,002 | B1 | 9/2001 | Comeau | |
| 6,302,666 | B1 | 10/2001 | Grupping | |
| 6,439,866 | B1 | 8/2002 | Farkas | |
| 6,467,557 | B1 | 10/2002 | Krueger | |
| 6,470,974 | B1 | 10/2002 | Moore | |
| 6,561,289 | B2 | 5/2003 | Portman | |
| 2003/0044299 | A1 * | 3/2003 | Thomas et al. | 418/206.9 |

* cited by examiner

*Primary Examiner*—William Neuder
(74) *Attorney, Agent, or Firm*—Law Office of Craig Bohn; Craig E. Bohn

(57) ABSTRACT

The present invention is a cylindrical linear fluid motor comprising a plurality of reciprocating rotary piston sleeve intermediate an inner coaxial hollow drive shaft and an outer coaxial cylindrical housing. Rotating disc valves at both ends of the sleeve piston control the sequential flow of high-pressure and low-pressure fluid through ports in both the drive shaft and the housing. High-pressure fluid acts on one end of the sleeve piston causing the piston to travel laterally along the drive shaft, with an inner set of roller balls in linear raceways ensuring no rotation between each piston and the drive shaft. The linear motion simultaneously affects exhausting of low-pressure fluid at the other end of the piston. Outer balls are seated in the housing and a sinusoidal circumferential raceway of each piston, to affect rotation in the piston from the lateral motion. As a piston reaches the limit of its linear travel the rotating disc valve on one end closes inlet ports and opens exhaust ports, while another rotating disc valve closes exhaust ports and opens inlet ports at the other end, causing the high-pressure fluid to reverse the piston's lateral direction of movement. The multiple pistons of a motor are rotationally sequenced to create consistent power production throughout 360-degree rotation, of the pistons.

21 Claims, 16 Drawing Sheets

SLEEVE PISTON FLUID MOTOR

CROSS-REFERENCE TO RELATED APPLICATIONS

This application claims the benefit of U.S. Provisional Application No. 60/448,559, filed Feb. 19, 2003.

STATEMENT REGARDING FEDERALLY SPONSORED RESEARCH OR DEVELOPMENT

Not Applicable.

BACKGROUND OF THE INVENTION

1. Field of the Invention

The invention relates to downhole positive displacement rotary motors of the type used for drilling operations.

2. Description of the Related Art

Linear downhole motors are widely known in the field of drilling operations. Motors are used to develop rotational drive on drilling implements from the drilling fluids forced through the drilling string. Typically, prior art motors use varying configurations of stator and rotor systems. Some examples of prior art systems follow:

U.S. Pat. No. 3,088,529 issued to Cullen et al. on May 7, 1963, discloses a cylindrical fluid-driven downhole engine having a central shaft possessing multiple rotors with moveable vanes contained in shaped stators in a linear casing that produce rotary motion in the shaft and attachable tools when fluid is forced through the casing configuration to sequentially push against vanes of the rotor.

U.S. Pat. No. 3,838,953 issued to Peterson on Oct. 1, 1974 discloses a cylindrical downhole rotor-stator motor, driven by a recirculating hydraulic system creating force against the rotor vanes independent of the fluid flushing system.

U.S. Pat. No. 3,876,350 issued to Warder on Apr. 8, 1975 discloses a positive displacement hydraulic-driven machine having fluid passages axially traveling the length of a central rotor shaft, providing inlet and outlet flow to multiple annular chambers defined by moveable linear vanes, a circumferential stator and a rotor. The device also employs a dumping valve, which continues to discharge fluid when stalling occurs.

U.S. Pat. No. 4,105,377 issued to Mayall on Aug. 8, 1978 discloses a hydraulic downhole roller motor wherein a core rotor possesses multiple external axial slots, wherein rod roller vanes are alternatingly compressed and withdrawn by forces of a shaped cylindrical housing and directed fluid flow, producing rotary motion in the core rotor and attachable tools.

U.S. Pat. Nos. 5,518,379, 5,785,509 and 5,833,444 issued to Harris et al. on May 21, 1996, Jul. 28, 1998 and Nov. 10, 1998, respectively, disclose variations of a fluid-driven downhole motor having a tubular rotor, with a central flow channel and radial, flow channels to direct the fluid to at least one action chamber between hollow tube stator and the tubular rotor, wherein the fluid acts on rolling vane rods, recessible in wells in the interior surface of the stator, producing rotary motion.

U.S. Pat. No. 6,302,666 B1 issued to Grupping on Oct. 16, 2001 discloses a roller vane motor for downhole drilling, wherein the housing is internally shaped to release and depress the roller vanes within wells in the rotor, producing rotation when fluid is forced through the housing.

It would be an improvement to the field to provide a fluid motor that produces rotational motion from reciprocation of multiple double-action piston sleeves by controlled application of hydraulic pressure to the ends of each piston sleeve. It would also be an improvement for a fluid motor to employ hydraulic energy of a fluid while preserving energy needed for other purposes in an application. It would also be an improvement for a fluid motor to be operable with either or both compressible and non-compressible fluids. It would also be an improvement to the field for a device to be adaptable to produce an output torque curve with simple design modifications.

BRIEF SUMMARY OF THE INVENTION

My invention is cylindrical fluid motor powered by the energy of pressurized fluid (gas or liquid) directed through structured valve ports to act upon multiple double acting reciprocating piston sleeves oriented along the axis of the drive shaft, which converts fluid pressure energy into uniform rotational speed and torque. The genuine nature of the invention permits creating both rotational torque from fluid power and fluid power from rotational torque. The specific design of a particular motor may be adapted to accept the input of power in either form in order to produce the other.

In the exemplary embodiment, the motor has a hollow drive shaft, into and through which a pressurized fluid flow is directed and selectively released through holes in drive shaft wall to cavities behind valve pistons. Valve pistons have inlet ports from their backside to a valve piston working face, and also exhaust ports from working face out to the side of valve piston to exhaust low-pressure fluid through exhaust ports in an outer tubular housing. The working face of rotating disc and valve piston form a seal to control fluid flow through inlet and exhaust ports. Opening and closing of inlet and exhaust ports is controlled by the shape of the ports and rotation of rotating disc. The sequencing of the opening and closing of inlet and exhaust ports is such that piston crowns and piston sleeves are forced back and forth along the axis of the drive shaft. In the exemplary embodiment, a full cycle of the back and forth motion occurs once for each piston in a particular motor during a single drive shaft rotation, or, as in a motor with four pistons, a fill cycle of the back and forth motion occurs four times per drive shaft rotation. Each piston sleeve travels on sets of roller balls on both the interior and exterior surfaces. The sets of roller balls are positioned intermediate each piston sleeve and coaxially inwardly and outwardly adjacent components. In the exemplary embodiment, the drive shaft is the inwardly adjacent component and the tubular housing is the outwardly adjacent component. One set of roller balls permit lateral axial motion, but does not permit radial movement, between the piston sleeve and the adjacent component, while the other set of roller balls induce rotational movement from forced lateral movement. The first set of roller balls are housed in lateral axial raceways contained in both the piston sleeve and the adjacent component, while the second set of roller balls is retained at a fixed position in one surface and housed in a sinusoidal circumferential raceway in the adjacent surface. As piston sleeves moves back and forth along the axis of the first set of roller balls, the second set of roller balls rotate around the axis following the sinusoidal circumferential raceway in one surface and forcing the fixed position of the adjacent component to rotate with the second set of roller balls. Configuration of sinusoidal circumferential raceway creates collaborative, symbiotic rotation of multiple double acting pistons of a motor, which yield uniform torque and rotation, providing fluid of constant pressure and flow is fed into the motor.

Accordingly, objects of my invention are to provide, inter alia, a positive displacement rotary motor that:

requires very little delta-P to generate high torque, which reduces the load on the pump and increases tubing life;

may be driven by a wide variety of non-compressible and compressible fluids, to include drilling mud, water or air;

has a short length and lightweight in order to make it easy to transport;

has a compact length to enable faster rig up;

is able to negotiate short-radius curves and severe doglegs that conventional motors cannot;

is able to operate in a wide variety of attitudes;

is able to operate at high temperatures without degrading the performance;

requires no transmission;

requires no gear reduction;

has balanced motor forces to limit vibration;

has sealed bearings for long life;

has constant torque and speed output throughout the complete rotation of the drive shaft, eliminating tool chatter, increasing cutting speed, reducing cutting tool wear, permitting the operation of the cutting tool at higher torques and making it easier for an operator to control an attached tool;

is self-governing for speed and torque;

is minimally affected by reasonable bearing wear, because as the bearings and bearing surfaces wear the timing of the motor is altered, but this alteration of timing shows its self at the top and bottom of the piston stroke when the piston is generating almost zero torque;

places no side loads on the motor bearings, yielding long life;

delivers high-pressure fluid to the bottom of the motor that could be used for other mechanical purposes;

does not stop the flow of fluid if the motor stalls, eliminating the problem of impacting the motor in the cuttings;

exhausts fluid through the side of the motor, creating turbulence around the motor as well as increasing the flow velocity of the fluid up the hole, which help to remove the cuttings up the hole and reduce the chances of impacting the motor;

can operate in high temperatures, permitting a wide range of applications and depths to be achieved;

is adjustable at the job site, by changing the orifice at the bottom of the motor and altering the fluid flow rate and pressure to the motor, providing a very wide range of performance parameters, thereby reducing the inventory of tools needed at a job site as well as the number of tools needed in inventory;

has the potential to be alterable in the hole in order to modify performance without extracting the drill string; and is not damaged if it stalls.

Other objects of my invention will become evident throughout the reading of this application.

Figure 1A:
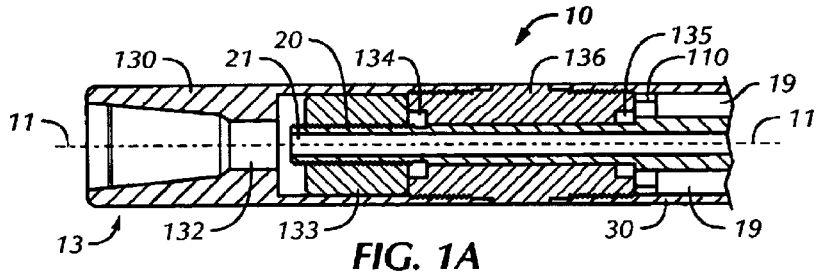
FIG. 1A is a cross-sectional side view of an exemplary string attachment end of the current invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring to FIGS. 1 and 12–15, motor 10 has a core axis 11, which runs through the center of motor 10 between string attachment end 13 and tool attachment end 14. At the axial center of motor 10 is coaxial drive shaft 20, having a coaxial core passageway 21, which provides fluid communication from string attachment end 13 and tool attachment end 14. Motor 10 has a tubular outer housing 30 that is coaxially distal core axis 11. Intermediate drive shaft 20 and outer housing 30 is a plurality of coaxial piston assemblies 40 and a plurality of fluid control assemblies 70.

Referring to FIG. 1A, motor 10 connects to a typical drill string (not shown) at string attachment end 13. Top sub 130 interfaces with the drill string and firmly attaches to same by means known in the field. Top sub 130 has core inlet orifice 132, which provides fluid communication to core passageway 21 from the drill string. Top sub 130 connects to shaft 20 and outer housing 30 in a fashion that permits shaft 20 to rotate freely around core axis 11 within outer housing 30. In the exemplary embodiment this connection is accomplished by inserting shaft 20 through a passageway coaxial with core axis 11 in thrust bearing housing 136. Thrust bearing housing 136 is designed to threadedly connect to both top sub 130 and outer housing 30 by threaded interfaces. Nut-side thrust bearing 134 and spring-side thrust bearing 135 provide smooth rotation of shaft 20 within thrust bearing housing 136. Shaft 20 is secured in the position through thrust bearing housing 136 by shaft nut 133, which has recessed seeming bolts, so as to provide a smooth interface with the interior cavity of top sub 130.

Figure 1B:
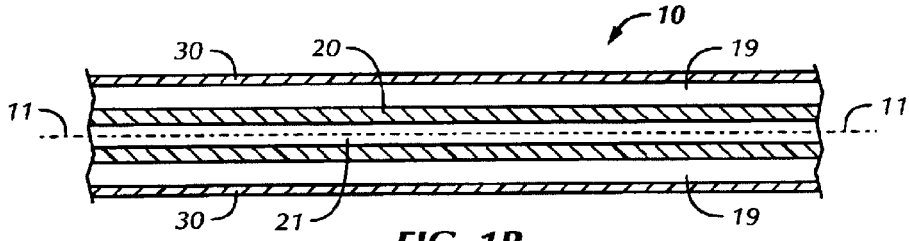
FIG. 1B is a cross-sectional side view of a motor housing intermediate an attachment end and a tool end of an embodiment of the current invention.
Figure 14:
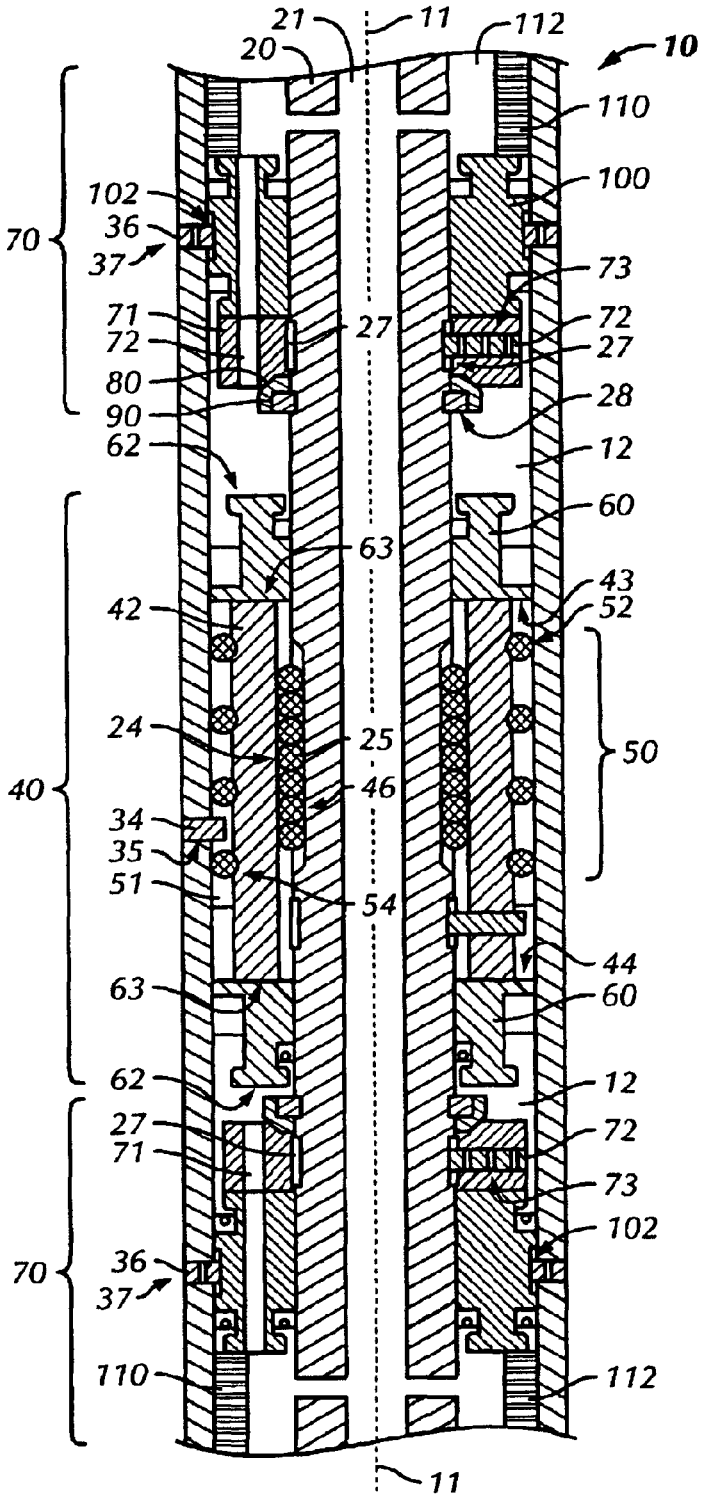
FIG. 14 is a schematic cross-sectional side view of a single sleeve piston section of the device in FIG. 1, cut in half along line 14—14.

Referring to FIGS. 1B and 14, shaft 20 and outer housing 30 run virtually the entire length of motor 10 and form an intermediate motor function cavity 19. The motor function cavity 19 contains the primary components of piston assembly 40 and fluid control assembly 70.

Figure 1C:
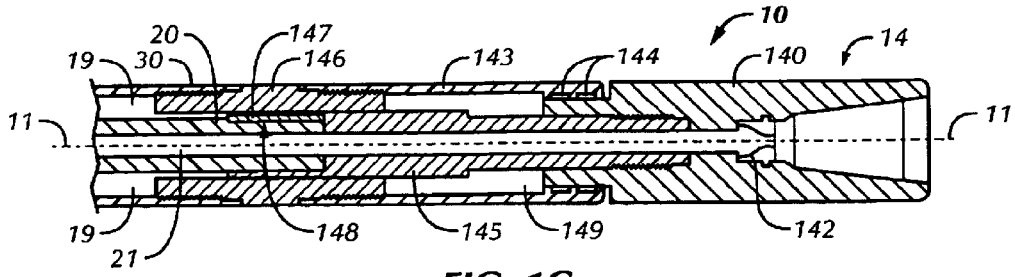
FIG. 1C is a cross-sectional side view of an exemplary tool attachment end of the current invention.
Figure 1D:
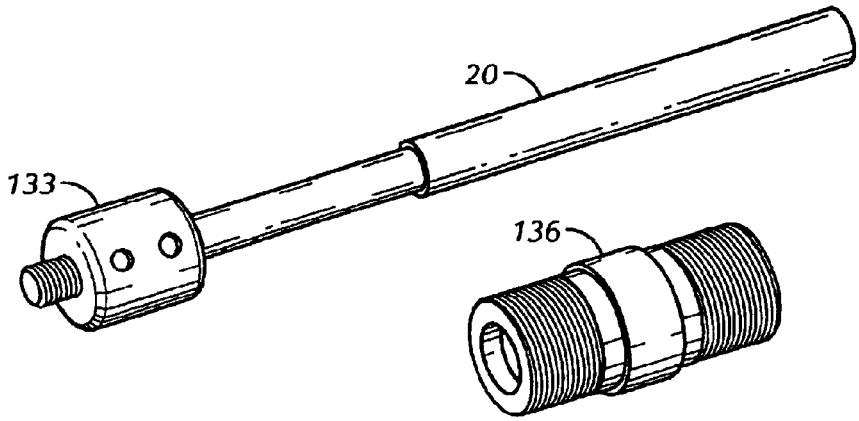
FIGS. 1D–1E are perspective views of the top shaft and outer housing connection components of an embodiment of the current invention.
Figure 1E:
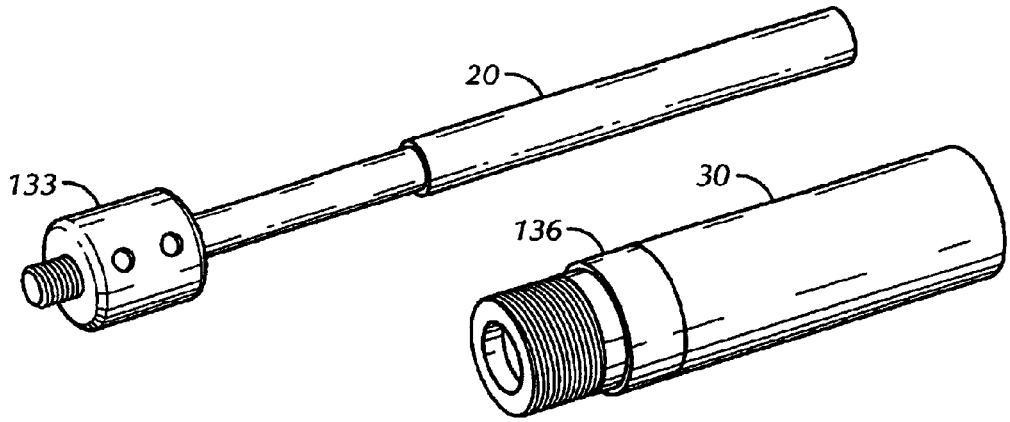

Referring to FIG. 1C, at the other end of motor 10, opposite attachment end i3, may be tool attachment end 14. Tool attachment end 14 may connect to a typical downhole tools (not shown), such as a drill bit, with a bottom sub 140. Bottom sub 140 has core exit orifice 142, which provides fluid communication from core passageway 21 to a tool. Bottom sub 140 connects to shaft 20 and outer housing 30 in a fashion that permits shaft 20 to rotate freely around core axis 11 within outer housing 30. In the exemplary embodiment this connection is accomplished by bottom sub 140 being securely fastened to slip shaft 145, while outer housing 30 connects to a housing terminus 143, which in turn, connects to bottom sub 140 with retaining terminus bearings 144.

Slip shaft 145 extends coaxially from shaft 20, as an extension that permits slight linear movement to lengthen and shorten the combination of shaft 20 and slip shaft 145. Exemplary slip shaft 145 rotates with shaft 20 because of a slip key 147 and slip key raceway 148 connection, interior to a shaft slip housing 146. Shaft slip housing 146 has a passageway coaxial with core axis 11 through which shaft 20 enters from one end and slip shaft 145 enters from the other. Shaft slip housing 146 is designed to threadedly connect to 146 both outer housing 30 and housing terminus 143 by threaded, interfaces. A two-piece needle/taper bearing 149 is positioned on slip shaft 145 intermediate shaft slip housing 146 and bottom sub 140.

Drive shaft 20 and outer housing 30 have a plurality of inlet ports 22 and exhaust ports 32, which provide fluid communication to fluid control assemblies 70, specifically inlet passageways 15 and exhaust passageways 17, respectively. Inlet passageways 15 and exhaust passageways 17 each have an interior end opposite their inlet port 22 or exhaust port 32, respectively, which, interior end accesses one of a plurality of pressure chambers 12, providing fluid communication to the respective inlet passageways 15 or exhaust passageways 17.

Each pressure chamber 12 delineates a circumferential interface between a piston assembly 40 and a fluid control assembly 70. Each piston assembly 40 resides between two pressure chambers 12 and two fluid control assemblies 70, and is comprised of a piston sleeve 42, potentially referred to as a sleeve piston, and two piston crowns 60. Each piston sleeve 42 is a hard circumferential sleeve that may move laterally along core axis 11, and has a first crown end 43 and a second crown end 44.

Referring to FIGS. 2 and 12–15, each piston sleeve 42 has a core surface 45 that interfaces with drive shaft 20 with an intermediate inner roller set 25. Each piston sleeve 42 has an outer surface 47 that interfaces with outer housing 30 with an intermediate outer roller set 50. The interfaces of core surface 45 and outer surface 47 must be of two complimentary types—one interface being a first linear raceway 24 and a second linear raceway 46, and the second interface being a circumferential sinusoidal raceway 48 and a fixed seat 54. Inner roller set 25 and outer roller set 50 each seat in either of these two types of interfaces. In the exemplary embodiment, drive shaft 20 houses first linear raceway 24 and core surface 45 of piston sleeve 42 houses second linear raceway 46, and outer surface 47 of piston sleeve 42 houses circumferential sinusoidal raceway 48 and outer housing 30 houses fixed seat 54.

Referring to FIGS. 3 and 12–15, in the exemplary embodiment, fixed seat 54 is a plurality of roller stall 52 of a roller retainer 51, wherein roller retainer 51 is sleeve intermediate piston sleeve 42 and outer housing 30. Roller retainer 51 has a plurality of roller stalls 52 for housing outer roller sets 50. Roller retainer 51 is fixed to outer housing 30 by roller retainer pins 34, which insert through roller retainer pin accesses 35 in outer housing 30, and anchor in roller retainer pin seat 53.

Referring to FIGS. 4, 5 and 12–15, a piston crown 60 is located at each crown end (43 and 44) of each piston sleeve 42. Piston crown 60 is a circumferential piece that prevents pressurized fluid from passing from pressure chamber 12 into piston assembly 40. Piston crown 60 has a sleeve face 63 that contacts crown end (43 or 44) and an acting face 62 that interfaces pressure chamber 12. In the exemplary embodiment, piston crown 60 has an inner seal seat 64 and an outer seal seat 67, into which inner seal 65 and outer seal 66 may be positioned. Exemplary seals are comprised of Viton®, but other materials, such as metal, Teflon®, and others are also suitable, depending on the application and performance parameters intended for the particular motor 10.

Referring to FIGS. 6–15, fluid control assembly 70 comprises the balance of the area intermediate drive shaft 20 and outer housing 30, and may vary greatly in many physical respects while still falling within the scope of this disclosure. The plurality of fluid control assemblies 70 are physically structured to work together to synchronize and coordinate the fluid communication of pressurized fluid to and from each pressure chamber 12.

In the exemplary embodiment fluid control assembly 70 is comprised of rotating disc 71, valve piston 100, spring 110 and spring cavity 112. Proximate inlet port 22, intermediate drive shaft 20 and outer housing 30 is spring cavity 112, in which circumferential spring 110 resides in order to maintain spring cavity 112 to sustain fluid communication with inlet port 22. Spring 110 has a valve side 115 that contacts valve piston 100, in order to permit valve piston 100, in order to adjust to forces of motor 10 during operation, while maintaining a proper position to maintain the integrity of inlet passageway 15 and exhaust passageway 17. Spring 110 also has a resistance side that may be in contact with an adjacent valve piston 100, or may be in contact with thrust bearing housing 136 at the string attachment end or shaft slip housing 146 at the tool attachment end 14, if the particular spring 110 is part of the first or last fluid control assembly 70, respectively, in motor 10.

Valve piston 100 houses distinct valve piston inlet passageways 16 and valve piston exhaust passageways 18, which are each part of an entire inlet passageway 15 and exhaust passageway 17, respectively. Valve piston inlet passageways 16 are run parallel to core axis 11, directly through valve piston 100 from inlet side 106 to chamber side 105. Valve piston exhaust passageways 18 run from chamber side 105 to outer surface 109, where exhaust passageway 17 communicates with exhaust port 32 in outer housing 30. Exemplary valve piston 100 has a pair of outer seal seats 104 on outer surface 109, one intermediate exhaust passageway 17 and each edge to chamber side 105 and inlet side 106, in order to ensure exhaust communication out exhaust port 32, rather that toward pressure chamber 12 or spring cavity 112.

Valve piston 100 is rotationally fixed to outer housing 30 by valve piston pins 36, which insert through valve piston pin accesses 37 in outer housing 30, to seat in valve piston seats 102. In the exemplary embodiment, valve piston seats 102 have a slightly oblong shape to allow valve piston 100 to adjust to forces during motor 10 operation.

From chamber side 105, each valve piston inlet passageway 16 and valve piston exhaust passageway 18 have oblong manifolds 101, which increase the area through which pressurized fluid may be directed into or out of valve piston 100. Oblong manifold's 101 size and percentage of area around the diameter of chamber side 105 determines the sequencing and duration of the flow of pressurized fluid to and from pressure chamber 12.

Rotating disc 71 is positioned intermediate pressure chamber 12 and valve piston 100. Rotating disc 71 is rotationally fixed to drive shaft 20 by rotating disc pins 72, which insert through radial rotating disc pin accesses 73, to seat in rotating disc pin seats 27 of drive shaft 20. Rotating disc passageways 74, which alternatingly form part of inlet passageways 15 and exhaust passageways 17, run axially through rotating disc 71 from valve side 75 to chamber side 76.

Rotating disc 71 is held in position, seated against valve piston 100, by shoulder 80 and retaining ring 90. The valve side of shoulder 80 has a beveled face 82, which is machined to seat in the beveled edge 81 of rotating disc 71. Shoulder 80 is held in place against rotating disc 71 by retaining ring 90, which has an inside diameter 92 slightly smaller that the outside diameter of drive shaft 20, so retaining ring 90 seats in retaining ring seat 28.

In Operation

Referring to FIGS. 12–15, exemplary motor 10 has a hollow drive shaft 20, into and through which a pressurized fluid flow (not shown) is directed and selectively released through multiple inlet ports 22 in drive shaft 20 to spring cavities 112 behind valve pistons 100. Each inlet port 22 is the entrance of selectively open inlet passageways 15, which when open traverses from inlet ports 22 into spring cavity 102 and valve piston inlet passageway 16. Valve pistons 100 have valve piston inlet passageways 16 from inlet side 106 to a valve piston chamber side 105 of valve piston 100, and also valve piston exhaust passageways 18 from valve piston chamber side 105 that exit out of the side of valve piston 100 to exhaust low-pressure fluid (not shown) through exhaust ports 32 in outer housing 30. The valve side 75 of rotating disc 71 and valve piston 100 form a seal to control fluid flow through the ports. Opening and closing of inlet and exhaust ports are controlled by rotation of rotating disc 71. The turning of the opening and closing of the inlet and exhaust ports is such that piston crowns 43 and 44 and piston sleeve 42 are forced back and forth along core axis on drive shaft 20. A full cycle of the back and forth motion occurs once for each piston in the particular motor 10 during a single drive shaft 20 rotation. In the exemplary embodiment with four pistons a full cycle of the back and forth motion occurs four times per drive shaft 20 rotation. Piston sleeve 42 travels on coordinated sets of inner roller set 25 and outer roller set 50. Inner roller set 25 is comprised of linear raceways 24 and 46, and outer roller set 50 is comprised of circumferential raceway 48 and a fixed seat 54. The configuration of the circumferential raceway 48 on the outside of the piston sleeve 42 in combination with the timing of the reciprocating motion yields uniform torque and rotation, providing fluid of constant pressure and flow is fed into through core passageway 21.

High-pressure fluid (not shown) is taken in from core passageway 21 of drive shaft 20 through inlet ports 22 and exhausted through outer housing 30 through the exhaust ports 32. The controlled flow of high-pressure fluid from core passageway 21 to exhaust ports 32 create systematic forces on the double acting piston sleeves 42, causing each piston sleeve 42 to move back and forth laterally along core axis 11. Piston sleeves 42 may move back and forth along core axis 11 with inner rollers 25 in first linear raceway 24 and second linear raceway 46, but cannot move in a radial direction in regards to drive shaft 12. Roller retainer 51 holds outer roller set 50 in a static position to the inside of outer housing 30. Outer roller set 50 operates in circumferential raceway 48 machined on the outside surface of piston sleeve 42, so that as piston sleeve 42 moves back and forth along core axis 11 piston sleeve 42 and drive shaft 20 are forced to rotate.

Circumferential raceways 48 are a circumferential series of radiuses 56 and ramps 57 in a sinusoidal pattern to control both the speed and torque of each double acting piston sleeve. The force generated by each piston sleeve 42 is governed by the pattern so the summation of the forces from all piston sleeves 42 remains constant throughout the rotation of drive shaft 20. The result is that as long as the flow and pressure of the fluid provided to motor 10 remains constant the speed and torque produced at tool attachment end 14 remain constant throughout rotation.

Referring to FIGS. 1A–1C, fluid pumped to the motor 10 may be much greater than motor 10 needs for the required speed output. Excess fluid goes through core passageway 21 and exits to the tool through core exit orifice 142.

Referring to FIGS. 12–15, in the exemplary embodiment, each piston sleeve 42 makes four cycles from the top of its stroke to the bottom and back per drive shaft 20 rotation. This means that the inlet ports 22 and exhaust ports 32 must open and close four times per drive shaft 20 rotation at each end of double acting piston sleeve 42. The ports open and close over 45° of drive shaft rotation. The plurality of fluid control assemblies 70 must work together to synchronize and coordinate the fluid communication of pressurized fluid to and from each pressure chamber 12 to force piston sleeves 42 back and forth along drive shaft 20.

Piston sleeve 42 timing is established so that each double acting piston 42 starts at top center 11.25° degrees of drive shaft 20 rotation after one other piston set in motor 10. The reason 11.25° is used is that each piston 42 goes from the top to the bottom of its stroke in 45° of drive shaft 20 rotation. As each double acting piston sleeve 42 must work during this 45° and must be equally spaced, dividing 45° by the number of piston sleeves 42, four (4), lets one arrive at the optimal radial spacing, 11.25°.

FIGS. 15–22 show the sequential positioning at every 11.25° of the pistons and valves through 90° of drive shaft 20 rotation. FIGS. 15C–22C and 15D–22D depict the interface between the particular valve piston 100 and rotating disc 71, showing the positioning of rotating disc passageway 74 with respect to the oblong manifold 101 of valve piston 100. FIGS. 15B–22B depict of where the inner piston sleeve is in relationship to its stroke by depicting a single outer roller 50B in a single circumferential raceway 48.

Figure 15C:
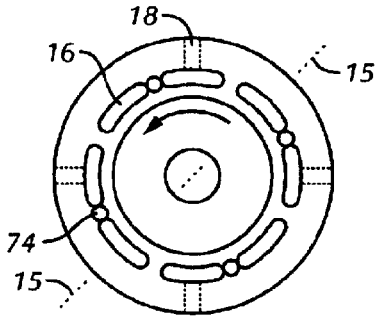
FIG. 15C is a cross-sectional end view of the piston of FIG. 15A, cut at line C—C.
Figure 15B:
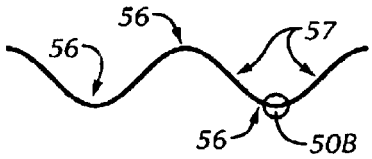
FIG. 15B is a depiction of the outer bearing positioning in the sleeve piston raceway of FIG. 15A.
Figure 15D:
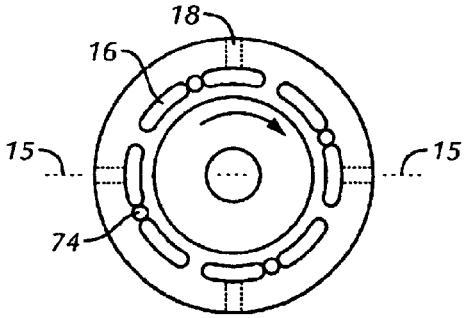
FIG. 15D is a cross-sectional end view of the piston of FIG. 15A, cut at line D—D.
Figure 15A:
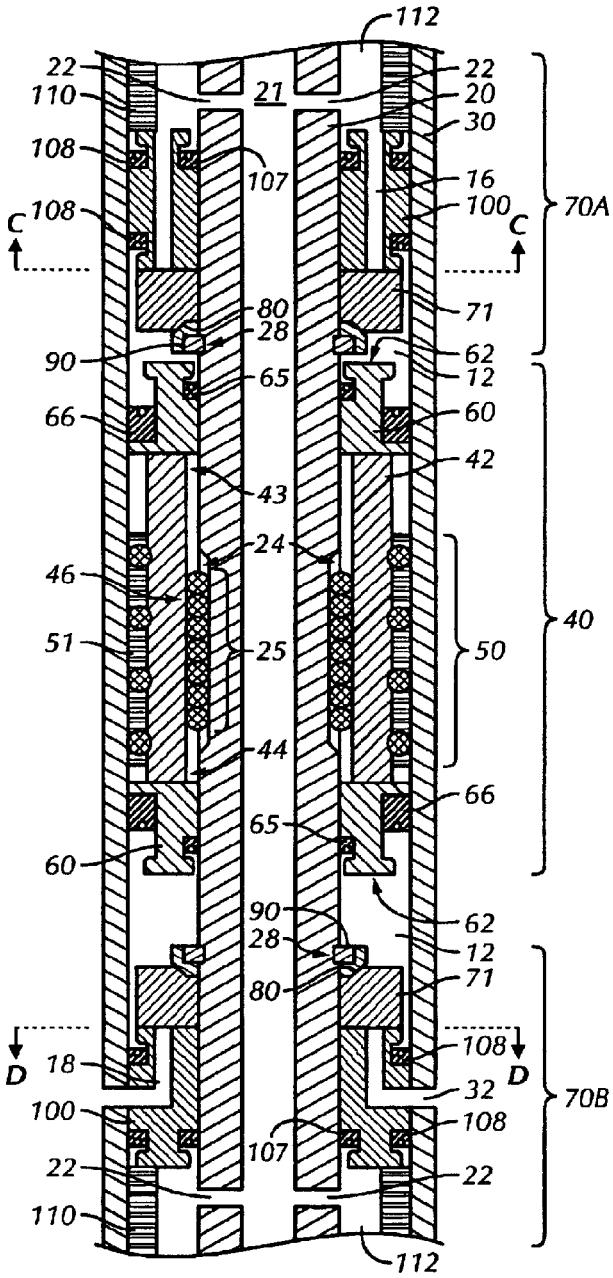
FIG. 15A is a schematic cross-sectional side view of a single sleeve piston of the device in FIG. 1, cut in half along line 15—15.

In FIG. 15A–15D, exemplary piston sleeve 42 is at the top dead center of a stroke. FIG. 15B shows that representative outer roller 50B is at the bottom center of a radius 56 of individual circumferential raceway 48. Rotating disc passageways 74 are intermediate adjacent oblong manifolds 101, so no inlet passageway 15 or exhaust passageway 17 is in existence. The instant piston assembly 40 is relying on forces on other piston sleeves 42 to rotate shaft 20 and fixedly attached top and bottom rotating discs 71 into position to align rotating disc passageways 74 with both valve piston inlet passageway 16 at the top and valve piston exhaust passageway 18 at the bottom. No fluid is passing through either fluid control assembly 70.

Figure 16C:
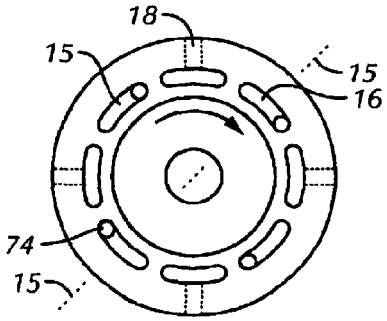
FIG. 16C is a cross-sectional end view of the piston of FIG. 16A, cut at line C—C.
Figure 16B:
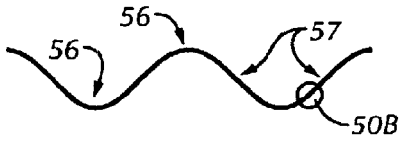
FIG. 16B is a depiction of the outer bearing positioning in the sleeve piston raceway of FIG. 16A.
Figure 16D:
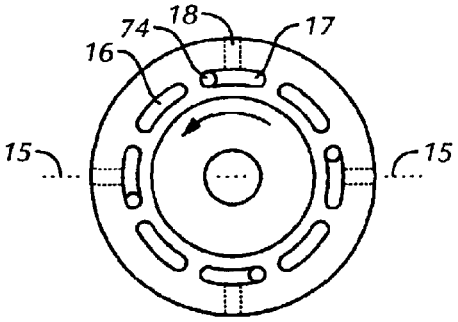
FIG. 16D is a cross-sectional end view of the piston of FIG. 16A, cut at line D—D.
Figure 16A:
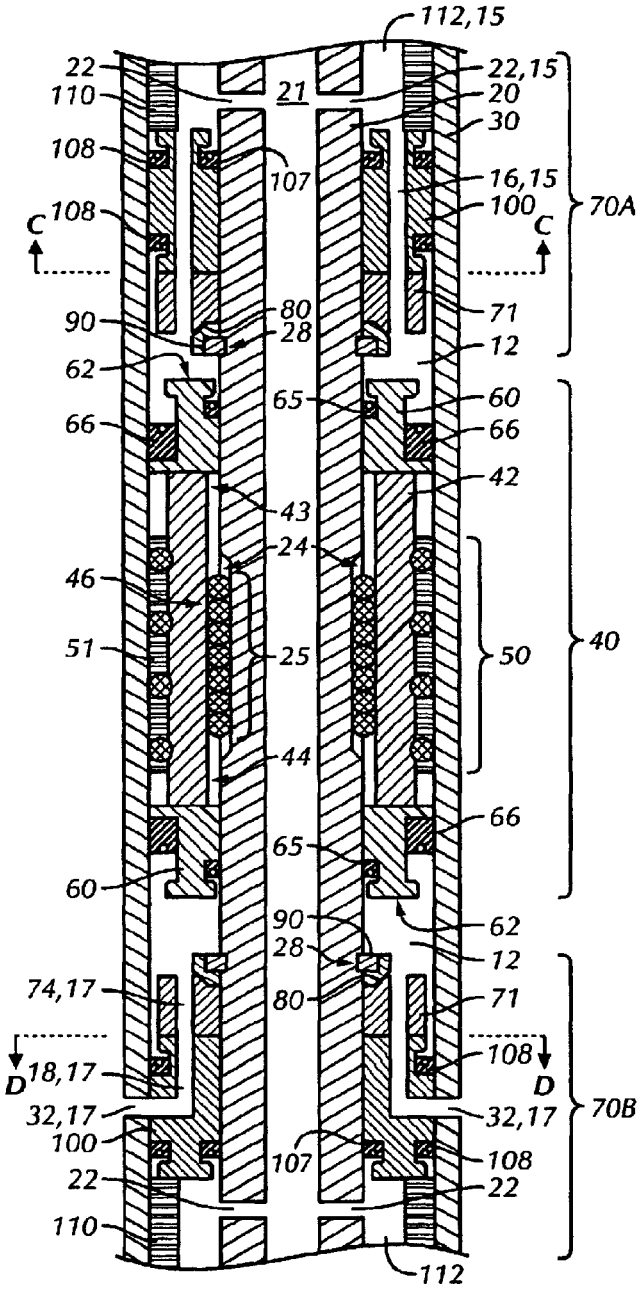
FIG. 16A is a schematic cross-sectional side view of a single sleeve piston of the device in FIG. 1, at 11.25 degrees of rotation from the view of FIG. 15A.

In FIGS. 16A–16D, exemplary piston sleeve 42 is rotated 11.25° from top dead center of a stroke. FIG. 16B shows that representative outer roller 50B is moving off the bottom center of radius 56 heading onto ramp 57 of individual circumferential, raceway 48. Rotating disc passageways 74 are aligned with the leading lobe of oblong manifolds 101, so that both top and bottom fluid control assemblies 70, 70A and 70B, respectively, are directing fluid. With the alignment of rotating disc passageways 74 and oblong manifolds 101, inlet passageway 15 exists in the top fluid control assembly 70A in combined inlet port 22, spring cavity 112, valve piston inlet passageway 16 and rotating disc passageway 74. At the same time, in the bottom fluid control assembly 70B exhaust passageway 17 exists in combined exhaust port 32, valve piston exhaust passageway 18 and rotating disc passageway 74. The instant piston assembly 40 is generating force for motor 10 to rotate shaft 20 and fixedly attached top and bottom rotating discs 71, as well as turn an attached tool, because pressurized fluid is entering top pressure chamber 12 through inlet passageway 15 and acting on acting face 62 of top piston crown 60, to push piston sleeve 42 away from pressure chamber 12. The linear action causes outer roller set 50 to progress along circumferential raceway, rotating shaft 20. In the bottom fluid control assembly 70B, the linear action of piston sleeve 42 causes acting face 62 of piston crown 60 to push fluid out of pressure chamber 60, through exhaust passageway 17.

Figure 17C:
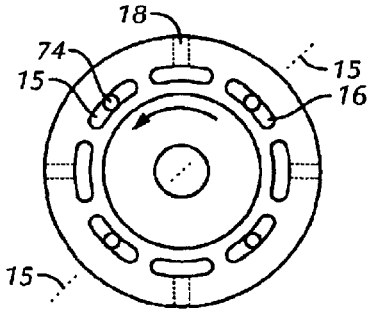
FIG. 17C is a cross-sectional end view of the piston of FIG. 17A, cut at line C—C.
Figure 17B:
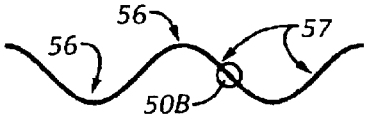
FIG. 17B is a depiction of the outer bearing positioning in the sleeve piston raceway of FIG. 17A.
Figure 17D:
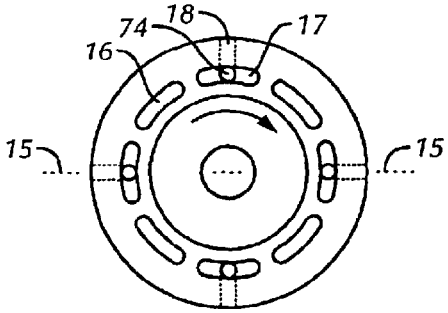
FIG. 17D is a cross-sectional end view of the piston of FIG. 17A, cut at line D—D.
Figure 17A:
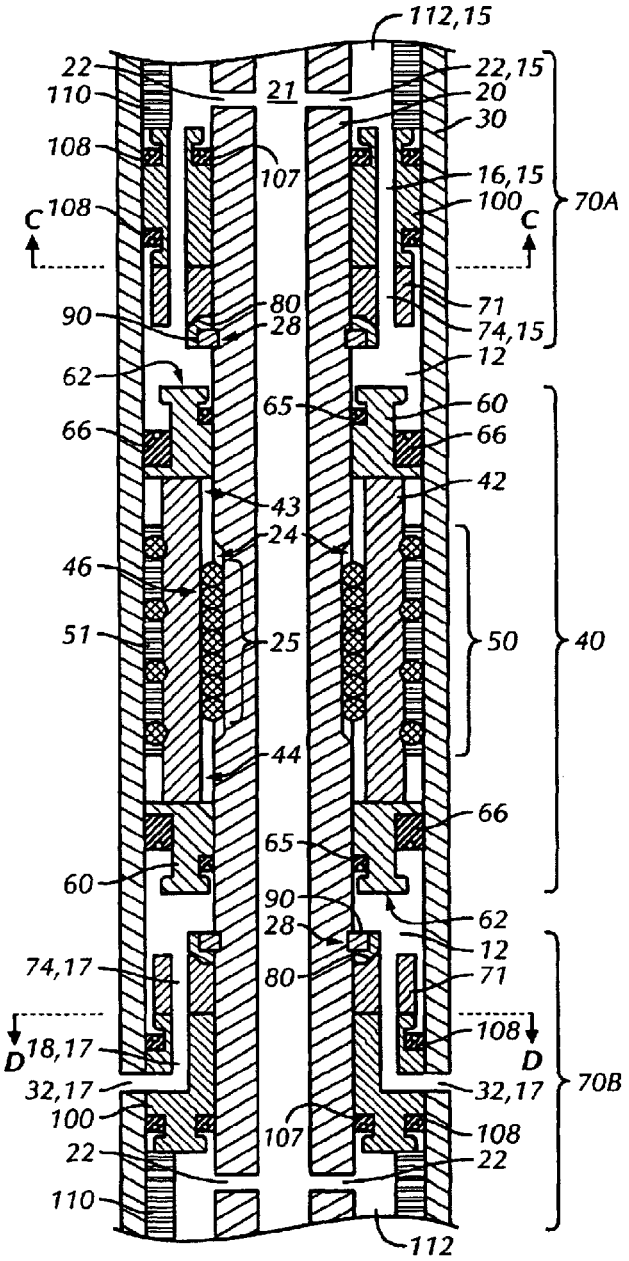
FIG. 17A is a schematic cross-sectional side view of a single sleeve piston of the device in FIG. 1, at 22.5 degrees of rotation from the view of FIG. 15A.

In FIGS. 17A–17D, exemplary piston sleeve 42 is rotated 22.5° from top dead center of a stroke. FIG. 17B shows that representative outer roller 50B is moving on ramp 57 of individual circumferential raceway 48. Rotating disc passageways 74 are aligned with the center of oblong manifolds 101, so that both top and bottom fluid control assemblies 70, 70A and 70B, respectively, are directing fluid. With the alignment of rotating disc passageways 74 and oblong manifolds 101, inlet passageway 15 exists in the top fluid control assembly 70A in combined inlet port 22, spring cavity 112, valve piston inlet passageway 16 and rotating disc passageway 74. At the same time, in the bottom fluid control assembly 70B exhaust passageway 17 exists in combined exhaust port 32, valve piston exhaust passageway 18 and rotating disc passageway 74. The instant piston assembly 40 is generating force for motor 10 to rotate shaft 20 and fixedly attached top and bottom rotating discs 71, as well as turn an attached tool, because pressurized fluid is entering top pressure chamber 12 through inlet passageway 15 and acting on acting face 62 of top piston crown 60, to push piston sleeve 42 away from pressure chamber 12. The linear action causes outer roller set 50 to progress along circumferential raceway, rotating shaft 20. In the bottom fluid control assembly 70B, the linear action of piston sleeve 42 causes acting face 62 of piston crown 60 to push fluid out of pressure chamber 60, through exhaust passageway 17.

Figure 18C:
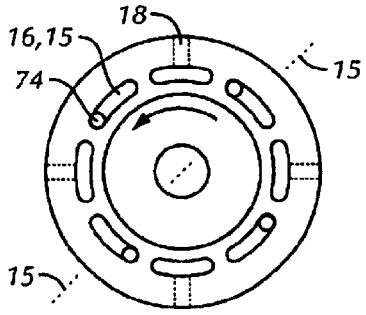
FIG. 18C is a cross-sectional end view of the piston of FIG. 18A, cut at line C—C.
Figure 18B:
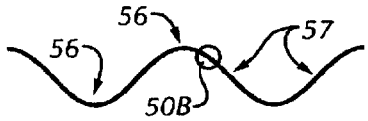
FIG. 18B is a depiction of the outer bearing positioning in the sleeve piston raceway of FIG. 18A.
Figure 18D:
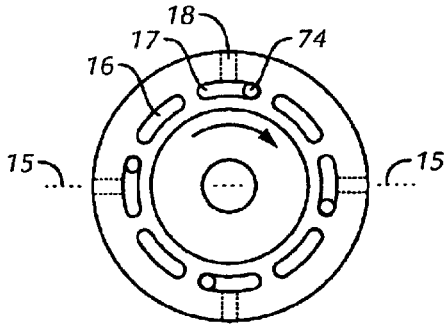
FIG. 18D is a cross-sectional end view of the piston of FIG. 18A, cut at line D—D.
Figure 18A:
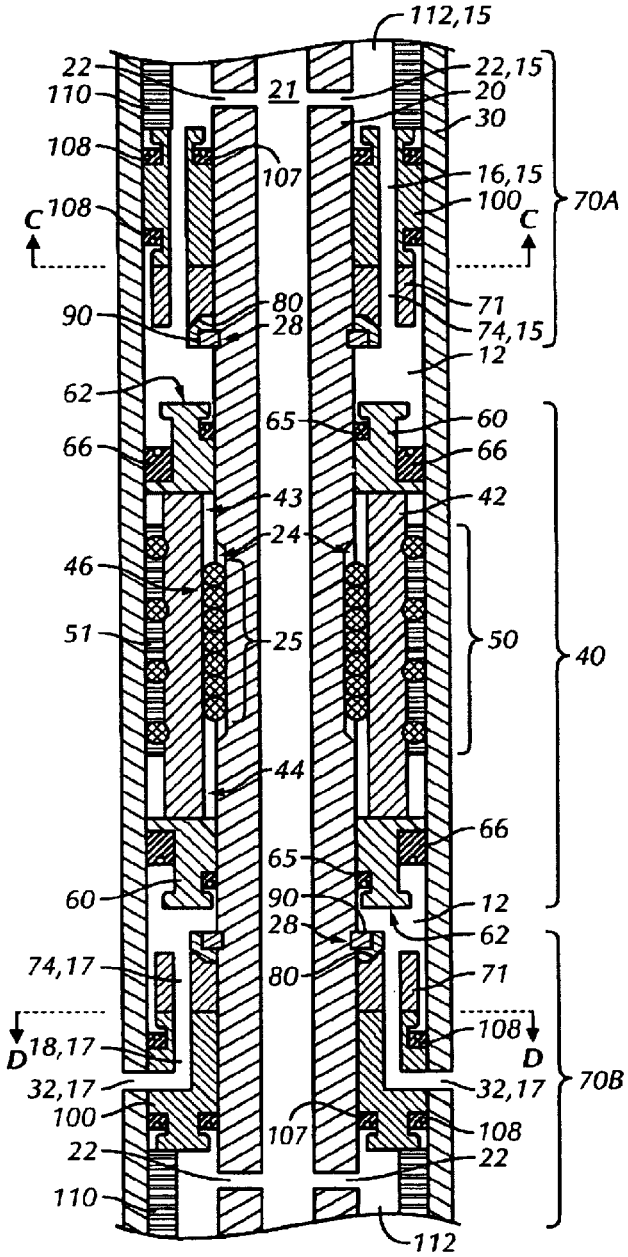
FIG. 18A is a schematic cross-sectional side view of a single sleeve piston of the device in FIG. 1, at 33.15 degrees of rotation from the view of FIG. 15A.

In FIGS. 18A–18D, exemplary piston sleeve 42 is rotated 33.75° from top dead center of a stroke. FIG. 18B shows that representative outer roller 50B is progressing along ramp 57 and onto radius 56 of individual circumferential raceway 48. Rotating disc passageways 74 are aligned with the trailing lobe of oblong manifolds 101, so that both top and bottom fluid control assemblies 70, 70A and 70B, respectively, are directing fluid. With the alignment of rotating disc passageways 74 and oblong manifolds 101, inlet passageway 15 still exists in top fluid control assembly 70A in combined, inlet port 22, spring cavity 112, valve piston inlet passageway 16 and rotating disc passageway 74. At the same time, in bottom fluid control assembly 70B exhaust passageway 17 still exists in combined exhaust port 32, valve piston exhaust passageway 18 and rotating disc passageway 74. The instant piston assembly 40 is still generating force for motor 10 to rotate shaft 20 and fixedly attached top and bottom rotating discs 71, as well as turn an attached tool, because pressurized fluid is entering top pressure chamber 12 through inlet passageway 15 and acting on acting face 62 of top piston crown 60, to push piston sleeve 42 away from pressure chamber 12. The linear action causes outer roller set 50 to progress along circumferential raceway, rotating shaft 20. In bottom fluid control assembly 70B, the linear action of piston sleeve 42 causes acting face 62 of piston crown 60 to push fluid out of pressure chamber 60, through exhaust passageway 17.

Figure 19C:
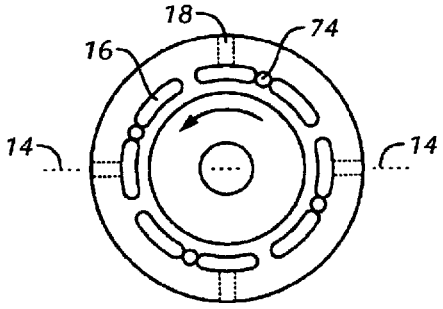
FIG. 19C is a cross-sectional end view of the piston of FIG. 19A, cut at line C—C.
Figure 19B:
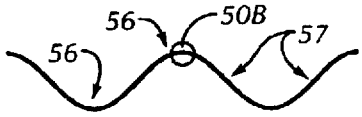
FIG. 19B is a depiction of the outer bearing positioning in the sleeve piston raceway of FIG. 19A.
Figure 19D:
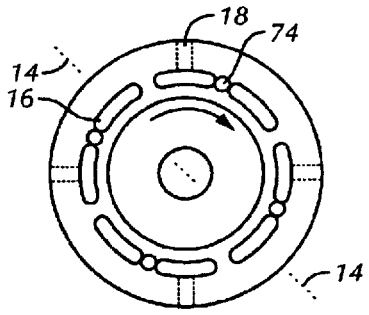
FIG. 19D is a cross-sectional end view of the piston of FIG. 19A, cut at line D—D.
Figure 19A:
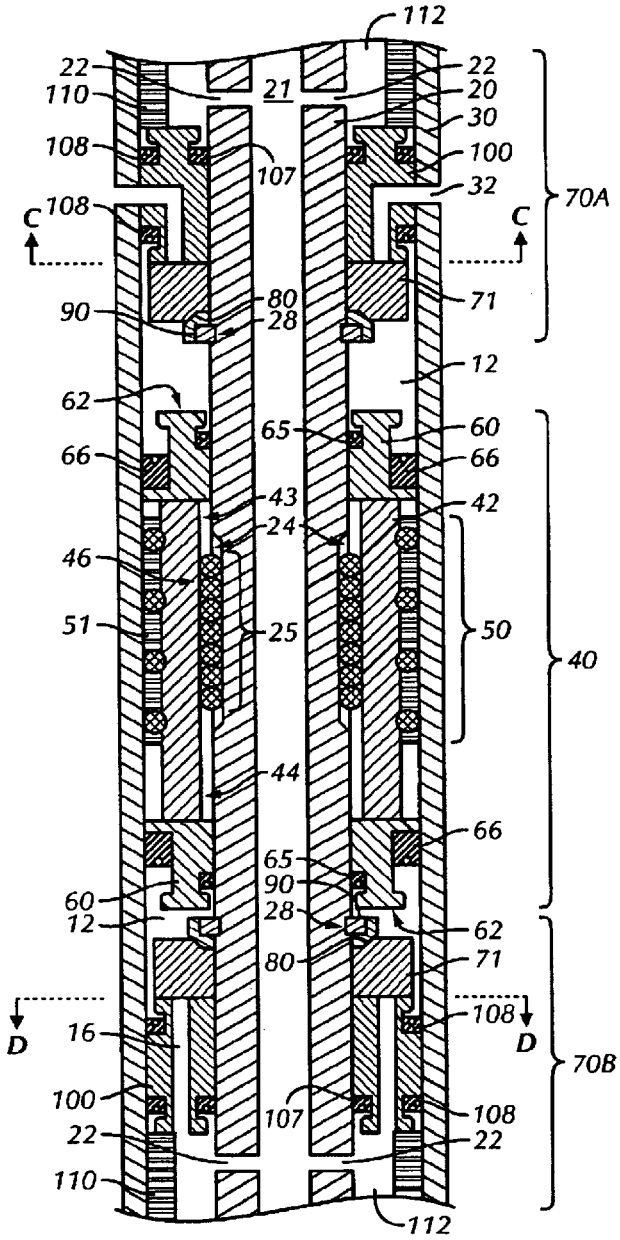
FIG. 19A is a schematic cross-sectional side view of a single sleeve piston of the device in FIG. 1 cut in half along line 14—14, at 45 degrees of rotation from the view of FIG. 15A.

In FIGS. 19A–19D, exemplary piston sleeve 42 is rotated 45° from top dead center of a stroke, which may also be called bottom dead center. FIG. 19B shows that representative outer roller 50B is at the top center of a radius 56 of individual circumferential raceway 48. Rotating disc passageways 74 are intermediate adjacent oblong manifolds 101, so no inlet passageway 15 or exhaust passageway 17 is in existence. The instant piston assembly 40 must rely on forces on other piston sleeves 42 to rotate shaft 20 and fixedly attached top and bottom rotating discs 71 into position to align rotating disc passageways 74 with both valve piston inlet passageway 16 at the top and valve piston exhaust passageway 18 at the bottom. No fluid is passing through either fluid control assembly 70.

Figure 20C:
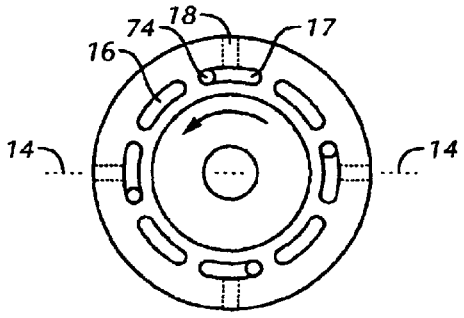
FIG. 20C is a cross-sectional end view of the piston of FIG. 20A, cut at line C—C.
Figure 20B:
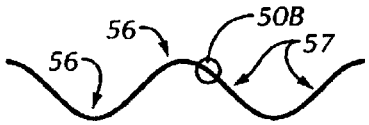
FIG. 20B is a depiction of the outer bearing positioning in the sleeve piston raceway of FIG. 20A.
Figure 20D:
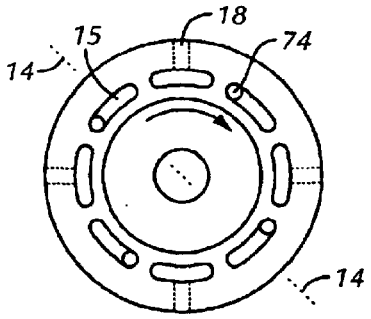
FIG. 20D is a cross-sectional end view of the piston of FIG. 20A, cut at line D—D.
Figure 20A:
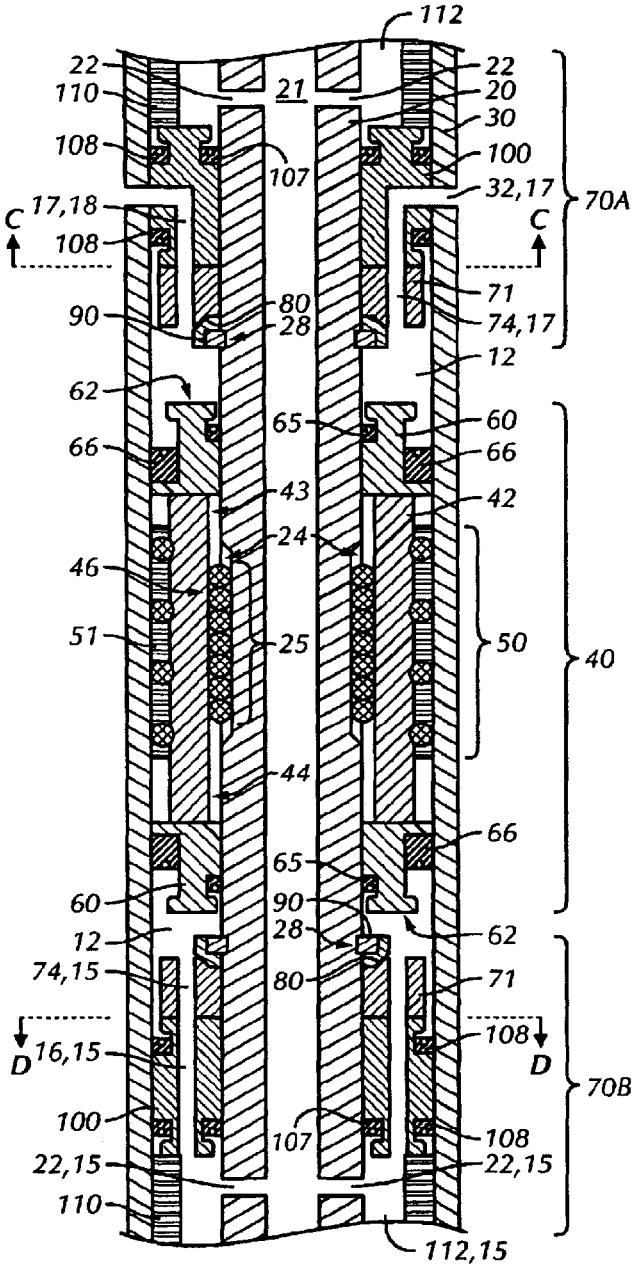
FIG. 20A is a schematic cross-sectional side view of a single sleeve piston of the device in FIG. 1 cut in half along line 14—14, at 56.25 degrees of rotation from the view of FIG. 15A.

In FIGS. 20A–20D, exemplary piston sleeve 42 is rotated 56.25° from top dead center of a stroke. FIG. 20B shows that representative outer roller 50B is moving off the bottom center of radius 56 heading onto ramp 57 of individual circumferential raceway 48. Rotating disc passageways 74 are aligned with the leading lobe of oblong manifolds 101, so that both top and bottom fluid control assemblies 70, 70A and 70B, respectively, are directing fluid. With the alignment of rotating disc passageways 74 and oblong manifolds 101, inlet passageway 15 exists in the top fluid control assembly 70A in combined inlet port 22, spring cavity 112, valve piston inlet passageway 16 and rotating disc passageway 74. At the same time, in the bottom fluid control assembly 70B exhaust passageway 17 exists in combined exhaust port 32, valve piston exhaust passageway 18 and rotating disc passageway 74. The instant piston assembly 40 is generating force for motor 10 to rotate shaft 20 and fixedly attached top and bottom rotating discs 71, as well as turn an attached tool, because pressurized fluid is entering top pressure chamber 12 through inlet passageway 15 and acting on acting face 62 of top piston crown 60, to push piston sleeve 42 away from pressure chamber 12. The linear action causes outer roller set 50 to progress along circumferential raceway, rotating shaft 20. In the bottom fluid control assembly 70B, the linear action of piston sleeve 42 causes acting face 62 of piston crown 60 to push fluid out of pressure chamber 60, through exhaust passageway 17.

Figure 21C:
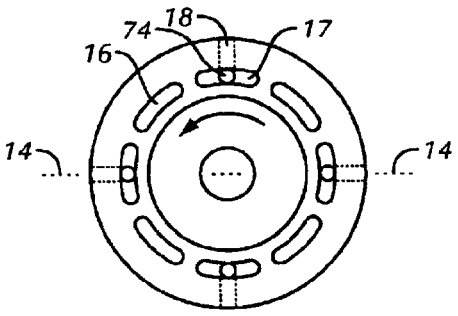
FIG. 21C is a cross-sectional end view of the piston of FIG. 21A, cut at line C—C.
Figure 21B:
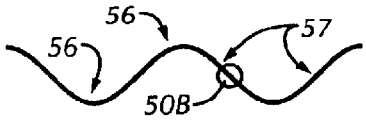
FIG. 21B is a depiction of the outer bearing positioning in the sleeve piston raceway of FIG. 21A.
Figure 21D:
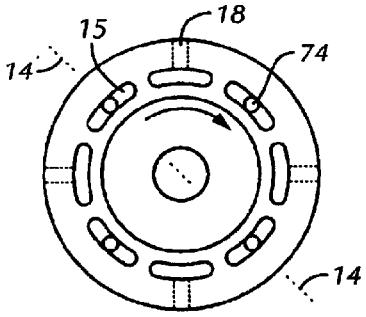
FIG. 21D is a cross-sectional end view of the piston of FIG. 21A, cut at line D—D.
Figure 21A:
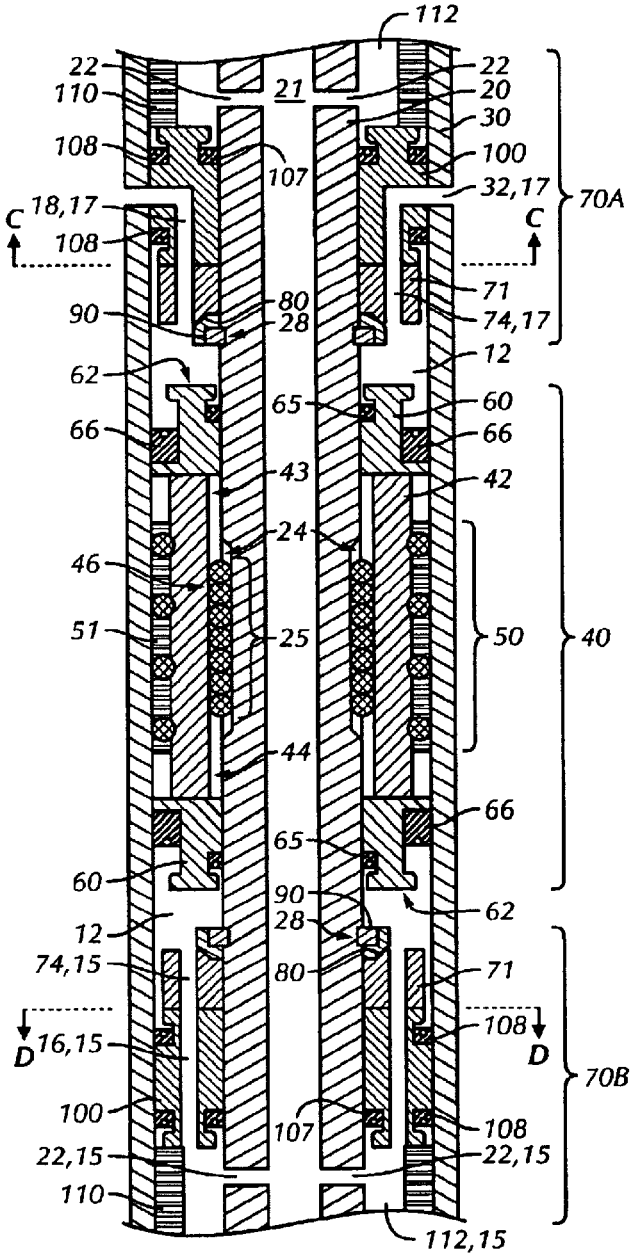
FIG. 21A is a schematic cross-sectional side view of a single sleeve piston of the device in FIG. 1 cut in half along line 14—14, at 67.5 degrees of rotation from the view of FIG. 15A.

In FIGS. 21A–21D, exemplary piston sleeve 42 is rotated 67.5° from top dead center of a stroke. FIG. 21B shows that representative outer roller 50B is moving on ramp 57 of individual circumferential raceway 48. Rotating disc passageways 74 are aligned with the center of oblong manifolds 101, so that both top and bottom fluid control assemblies 70, 70A and 70B, respectively, are directing fluid. With the alignment of rotating disc passageways 74 and oblong manifolds 101, inlet passageway 15 exists in the top fluid control assembly 70A in combined inlet port 22, spring cavity 112, valve piston inlet passageway 16 and rotating disc passageway 74. At the same time, in the bottom fluid control assembly 70B exhaust passageway 17 exists in combined exhaust port 32, valve piston exhaust passageway 18 and rotating disc passageway 74. The instant piston assembly 40 is generating force for motor 10 to rotate shaft 20 and fixedly attached top and bottom rotating discs 71, as well as turn an attached tool, because pressurized fluid is entering top pressure chamber 12 through inlet passageway 15 and acting on acting face 62 of top piston crown 60, to push piston sleeve 42 away from pressure chamber 12. The linear action causes outer roller set 50 to progress along circumferential raceway, rotating shaft 20. In the bottom fluid control assembly 70B, the linear action of piston sleeve 42 causes acting face 62 of piston crown 60 to push fluid out of pressure chamber 60, through exhaust passageway 17.

Figure 22C:
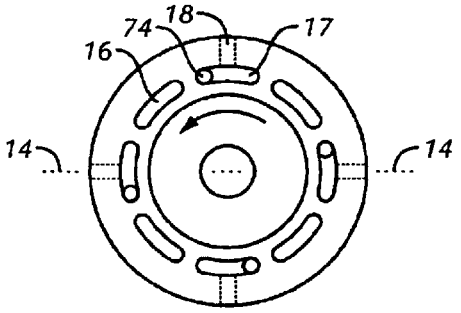
FIG. 22C is a cross-sectional end view of the piston of FIG. 22A, cut at line C—C.
Figure 22B:
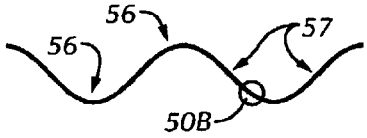
FIG. 22B is a depiction of the outer bearing positioning in the sleeve piston raceway of FIG. 22A.
Figure 22D:
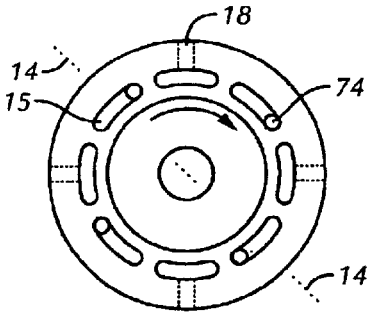
FIG. 22D is a cross-sectional end view of the piston of FIG. 22A, cut at line D—D.
Figure 22A:
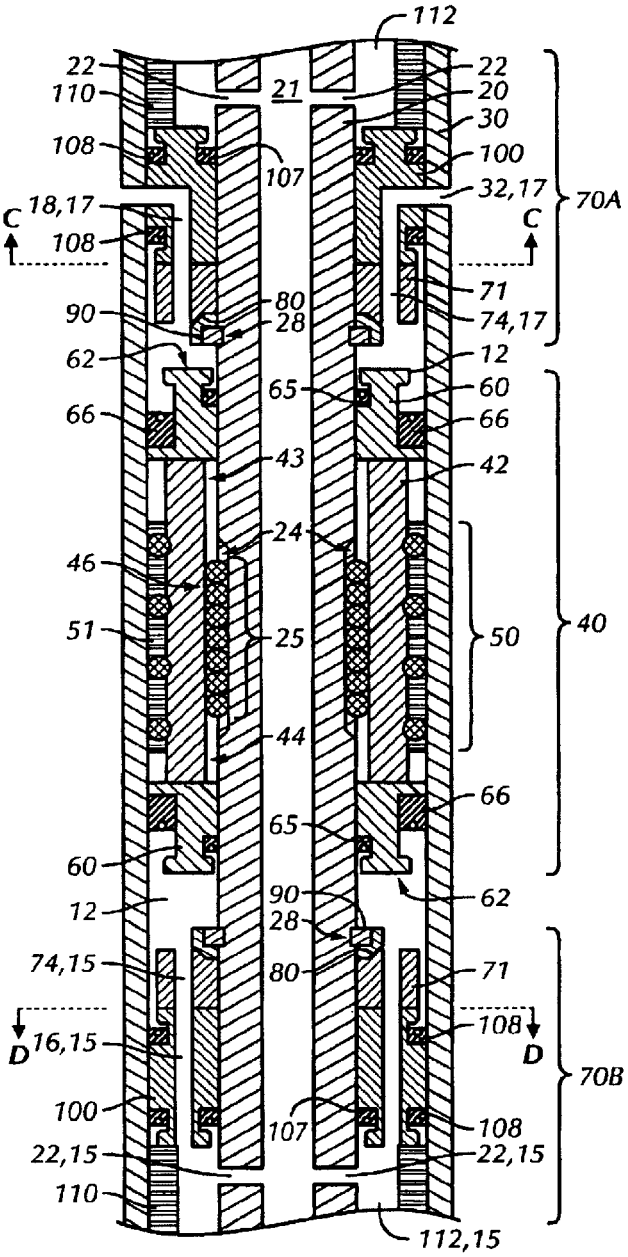
FIG. 22A is a schematic cross-sectional side view of a single sleeve piston of the device in FIG. 1 cut in half along line 14—14, at 78.75 degrees of rotation from the view of FIG. 15A.

In FIGS. 22A–22D, exemplary piston sleeve 42 is rotated 78.75° from top dead center of a stroke. FIG. 22B shows that representative outer roller 50B is progressing along ramp 57 and onto radius 56 of individual circumferential raceway 48. Rotating disc passageways 74 are aligned, with the trailing lobe of oblong manifolds 101, so that both top and bottom fluid control assemblies 70, 70A and 70B, respectively, are directing fluid. With the alignment of rotating disc passageways 74 and oblong manifolds 101, inlet passageway 15 still exists in top fluid control assembly 70A in combined inlet port 22, spring cavity 112, valve piston inlet passageway 16 and rotating disc passageway 74. At the same time, in bottom fluid control assembly 70B exhaust passageway 17 still exists in combined exhaust port 32, valve piston exhaust passageway 18 and rotating disc passageway 74. The instant piston assembly 40 is still generating force for motor 10 to rotate shaft 20 and fixedly attached top and bottom rotating discs 71, as well as turn an attached tool, because pressurized fluid is entering top pressure chamber 12 through inlet passageway 15 and acting on acting face 62 of top piston crown 60, to push piston sleeve 42 away from pressure chamber 12. The linear action causes outer roller set 50 to progress along circumferential raceway, rotating shaft 20. In bottom fluid control assembly 70B, the linear action of piston sleeve 42 causes acting face 62 of piston crown 60 to push fluid out of pressure chamber 60, through exhaust passageway 17.

The next 11.25° of rotation returns fluid control assemblies 70A and 70B, and piston assembly 40 to the configuration depicted in FIG. 15, and the sequence repeats until the flow of pressurized fluid through core passageway 21 is curtailed.

Figure 2:
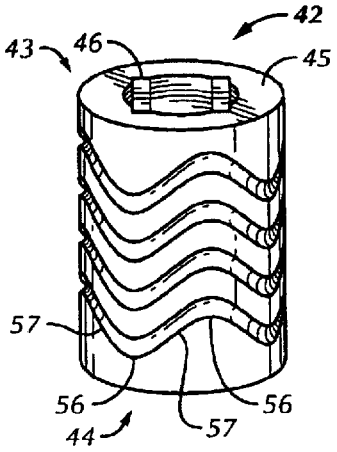
FIG. 2 is a perspective view of an exemplary sleeve piston.
Figure 3:
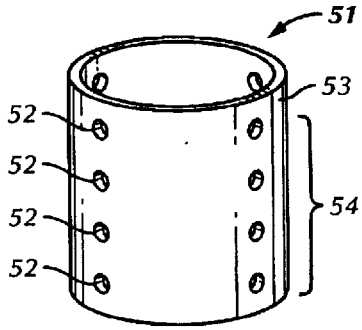
FIG. 3 is a perspective view of an exemplary roller retainer.
Figure 4:
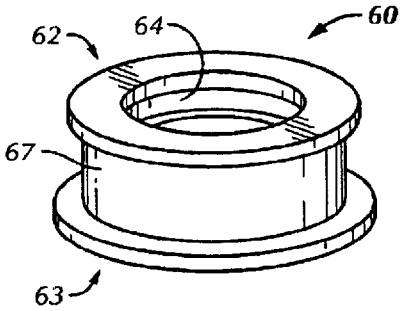
FIG. 4 is a perspective view of an exemplary piston crown.
Figure 5:
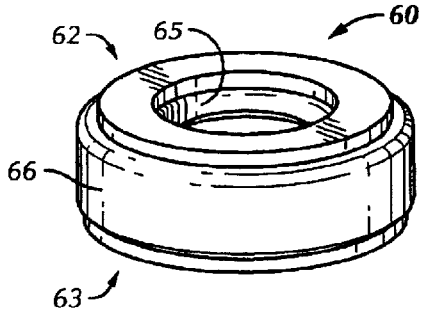
FIG. 5 is a perspective view of the piston crown of FIG. 4, with an outer seal.
Figure 6:
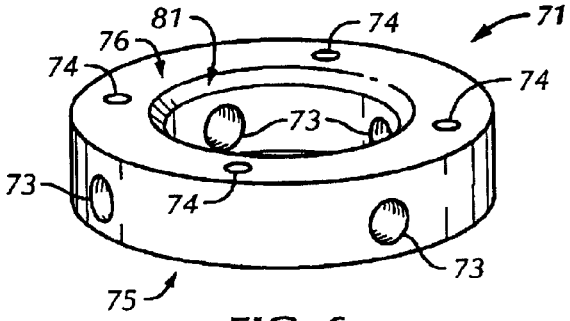
FIG. 6 is a perspective view of an exemplary rotating disc.
Figure 7:
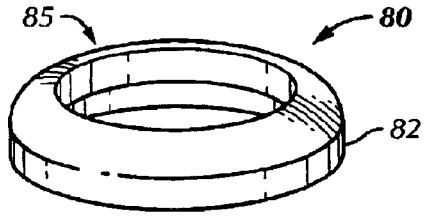
FIG. 7 is a perspective view of an exemplary shoulder.
Figure 8:
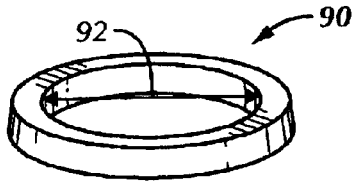
FIG. 8 is a perspective view of an exemplary retaining ring.
Figure 9:
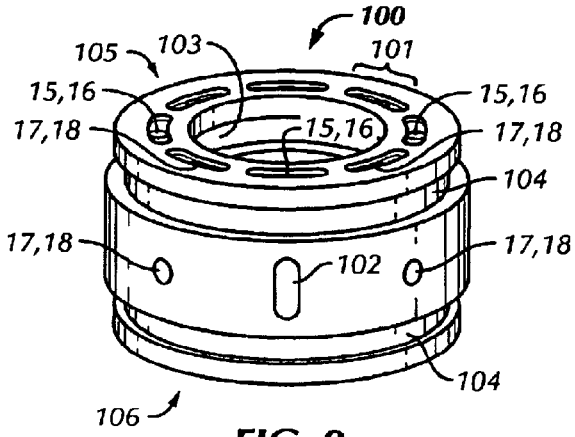
FIG. 9 is a perspective view of the chamber side of an exemplary valve piston.
Figure 10:
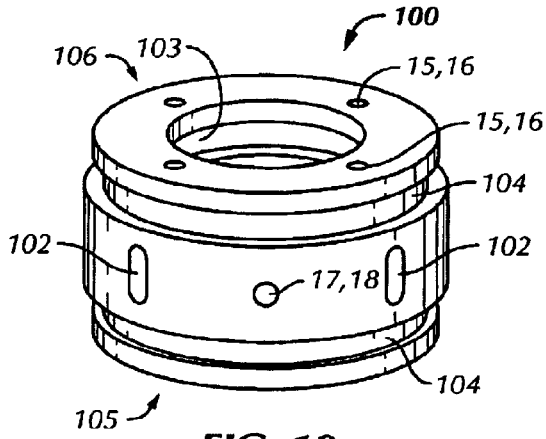
FIG. 10 is a perspective view of the inlet side of an exemplary valve piston.
Figure 11:
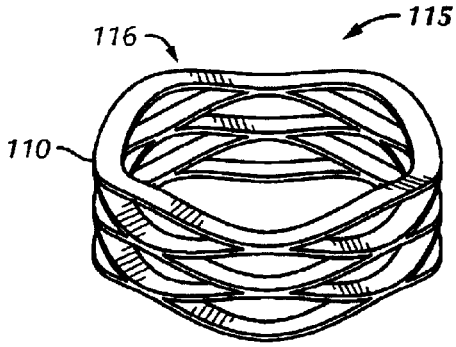
FIG. 11 is a perspective view of an exemplary spring.
Figure 12:
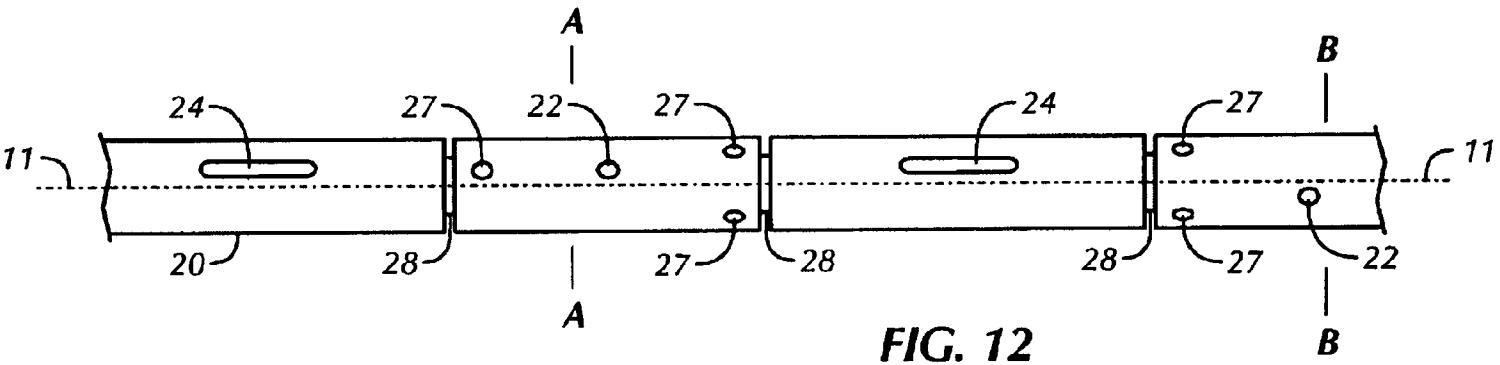
FIG. 12 is a side view of a section of the drive shaft for the device of FIG. 1.
Figure 13:
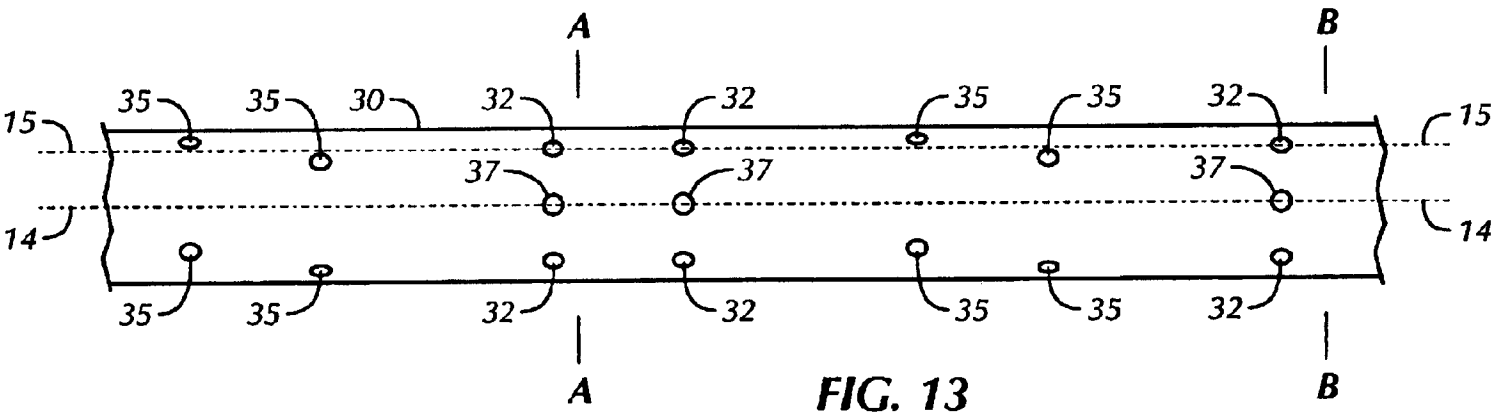
FIG. 13 is a side view of a section of the outer housing for the device of FIG. 1.
Figure 23:
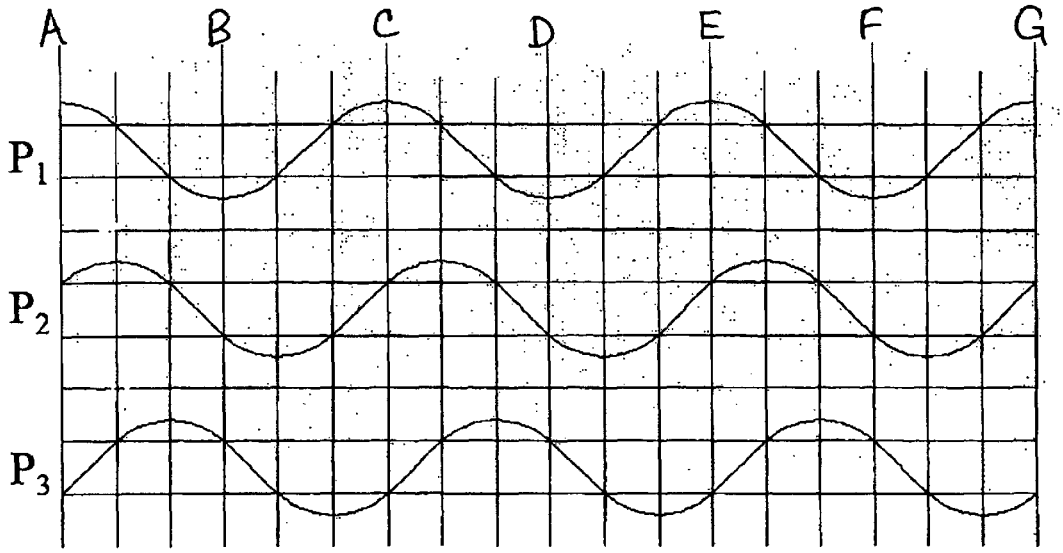
FIG. 23 is an exemplary cyclical torque chart for an exemplary three-piston fluid motor according to the present invention.
Figure 24:
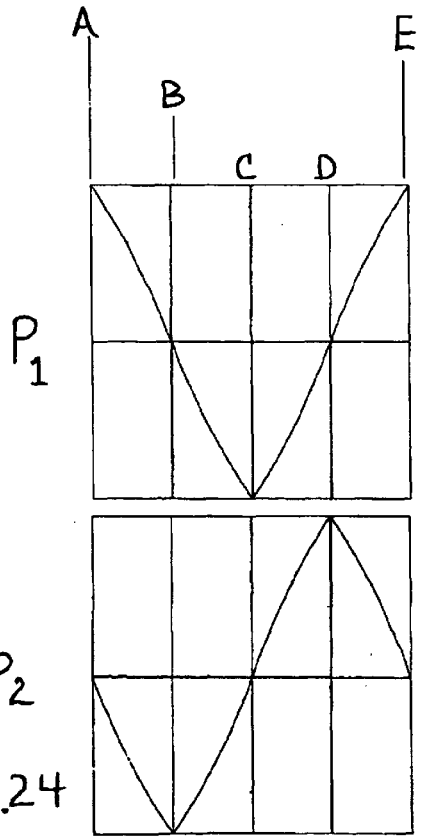
FIG. 24 is an exemplary cyclical torque chart for an exemplary two-piston fluid motor according to the present invention.

Referring to FIGS. 2, 23 and 24, the inventive fluid motor is extremely flexible in the variety of embodiments that may be designed and achieved. Though the embodiment shown throughout the majority of this disclosure possesses four piston sleeves 42, embodiments with fewer or more piston sleeves 42 are possible and may provide specific benefits for particular purposes. Part of the flexibility of the invention is in the way the performance characteristics of a particular motor may be modified by modifying the configuration of radiuses 56 and ramps 57 of circumferential raceways 48. This flexibility may extend to circumferential raceways 48 having a non-sinusoidal pattern, if an application would require a specific pattern of torque response throughout a single rotation of piston sleeve 42.

Referring to FIG. 23, an exemplary torque profile is shown for a motor 10 having three piston sleeves 42 (P1, P2 and P3). The cycle shown from time line A to time line G may represent one revolution of a motor 10 wherein the piston sleeves 42 possess a circumferential raceway 48 that similarly has three top radiuses 56. Time lines C and E would in that exemplary embodiment each mark the simultaneous 120-degrees of rotation of all three piston sleeves 42 (P1, P2 and P3). In that instance, piston sleeve P2 would lag piston sleeve P1 by 40-degrees and piston sleeve P3 would lag piston sleeve P1 by 80-degrees. However, if the cycle shown from time line A to time line G were to represent three revolutions of a motor 10, with one revolution occurring between each of time lines A and C, C and E, and E and G, then piston sleeves 42 would possess circumferential raceway 48 that similarly has only one top radius 56. Time lines B, C, D, E, F, and G would in that exemplary embodiment each mark the simultaneous 180-degree of rotation of all three piston sleeves 42 (P1, P2 and P3). In that instance, piston sleeve P2 would lag piston sleeve P1 by 60-degrees and piston sleeve P3 would lag piston sleeve P1 by 120-degrees.

Referring to FIG. 24, an exemplary torque profile is shown for a motor 10 having two piston sleeves 42 (P1 and P2). The cycle shown from time line A to time line E may represent one revolution of a motor 10 wherein the piston sleeves 42 possess a circumferential raceway 48 that similarly has only one top radius 56, peaking at both time lines A and E. Time lines B, C, D and E would in that exemplary embodiment each mark the simultaneous 72-degrees of rotation of all three piston sleeves 42 (P1, P2 and P3). In that instance depicted piston sleeve P2 would lag piston sleeve P1 by 72-degrees.

Given the examples of the torque profiles of the exemplary motors depicted in FIGS. 23 and 24 it is understandable that a torque profile that may be charted may provide the profile needed in a particular circumferential raceway 48 of the motor 10 that would produce the charted results.

Though the disclosure has use the exemplary embodiment of a fluid motor similar to one suitable for use in coil tubing operations, it is understood that the invention goes beyond this single application. Such other suitable applications include pumping operations where positive rotation torque is applied to the drive shaft while the housing is held stationary. In that instance one skilled in the art will readily see that fluid may be drawn by the pump and, for example without limiting this disclosure, draw fluid from the region surrounding the motor into the drive shaft and up an attached string. With a similar positive torque the motor may also operate as a compressor, gathering fluid from wherever the inlet passageways 15 are configured and forcefully transporting that fluid to wherever the exhaust or outlet passageways 17 are configured.

The present invention is directed to an apparatus for transitioning fluid power into torque. In one illustrative embodiment, the device comprises at least one piston sleeve, a drive shaft, a housing, inlet passageways, outlet passageways, and a valve system, said piston sleeves and said valve system intermediate and operatively connected to said drive shaft and said housing, each said piston sleeve having opposing ends, a first interface between said drive shaft and each said piston sleeve and a second interface between said housing and each said piston sleeve, said first interface and said second interface being each a different one of either of a linear interface and a combination interface such that linear motion in said piston sleeve results in rotation of said drive shaft relative to said housing, said inlet passageways and said outlet passageways capable of supporting portions of said fluid flow, and said valve system operative to coordinate intermittent flow of said portions of said fluid flow within each of said inlet passageway and each said outlet passageway such that said inlet passageways and said outlet passageways become alternatingly accessible to said opposing ends of each said piston sleeve. Other variations of this embodiment include said linear interface having a linear roller set and a linear pair of opposing raceways, and said combination interface having a combination roller set and a combination pair of opposing raceways, said combination pair of opposing raceways comprising a fixed point raceway and a circumferential raceway having radiuses and ramps. Other variations of this embodiment include a configuration of said circumferential raceway having radiuses and ramps determinative of said apparatus' operational performance. Other variations of this embodiment include one of said drive shaft and said housing attachable to a pressurize fluid supply and the other attachable to a rotary tool. Other variations of this embodiment include one of said drive shaft and said housing attachable to a rotary power supply and the other in fluid communication with a fluid supply. And still another variation of this embodiment includes said drive shaft having an interior for supporting fluid flow.

In another embodiment, the device comprises fluid motor for manipulating a fluid, said motor comprising a housing, said housing having an exterior surface, and an axial hollow interior core, at least one piston sleeve, said piston sleeves generally cylindrical in shape, having an exterior surface and an axial hollow interior core, each said piston sleeve coaxially positioned within said hollow interior core of said housing, each said piston sleeve having opposing piston crowns, a drive shaft, said drive shaft generally cylindrical in shape, having an exterior surface and an axial hollow interior core capable of supporting a fluid flow, said drive shaft coaxially positioned within said hollow interior core of said piston sleeve, each said piston sleeve capable of both lateral and rotational motion, said lateral and rotational motion of said piston sleeve directly related, said piston sleeve operatively connected to said drive shaft and said housing such that one of said drive shaft and said housing rotates with said piston sleeve in relation to the other of said drive shaft and said housing, said inlet and outlet passages, each capable of supporting portions of said fluid flow to coordinatedly provide fluid communication to and from each of said piston crowns, and a valve system operatively connected with each of said piston sleeves, said drive shaft, said housing, said inlet flow passages and said outlet flow passages to coordinate alternatingly sequenced fluid communication of said portions of said fluid flow to and from each of said piston crowns. Other variations of this embodiment include said inlet and outlet passages, each capable of alternatingly providing fluid communication to and from each of said piston crowns. Other variations of this embodiment include complimentingly different corresponding pairs of raceways being an outside interface raceway pair and an inside interface raceway pair, said outside interface raceway pair comprising a raceway on said axial hollow interior core of said housing and said exterior surface of said sleeve piston, said inside interface raceway pair comprising a raceway on said axial hollow interior core of said sleeve piston and said exterior surface of said drive shaft, and two interface pairs comprising said piston sleeve and said housing, and said drive shaft and said piston sleeve, each of said outside interface raceway pair and said inside interface raceway pair adapted to either of permitting lateral motion while prohibiting rotational motion and permitting lateral motion directly related to rotational motion, between respective said interface pair. Other variations of this embodiment include a first said complimentingly different corresponding pair of raceways comprising a fixed point raceway and a circumferential raceway having radiuses and ramps, and a second said complimentingly different corresponding pair of raceways comprising at least one linear raceway. Other variations of this embodiment include one of said drive shaft and said housing attachable to a pressurized fluid supply and the other attachable to a rotary tool. Other variations of this embodiment include one of said drive shaft and said housing attachable to a rotary power supply and the other in fluid communication with a fluid supply.

In another embodiment, the device comprises at least one piston sleeve, a drive shaft, a housing, inlet passageways, outlet passageways, and a means for valving said inlet and outlet passageways, said piston sleeves and said valve system intermediate and operatively connected to said drive shaft and said housing, a means for interfacing said piston sleeves with said drive shaft and said housing, said interfacing means providing a direct relationship between linear motion in said piston sleeves and rotation of said drive shaft relative to said housing, said inlet passageways and said outlet passageways capable of supporting portions of said fluid flow, and said valving means operative to coordinate intermittent flow of said portions of said fluid flow within each of said inlet and said outlet passageways such that said inlet passageways and said outlet passageways become alternatingly accessible to opposing ends of each said piston sleeve. Other variations of this embodiment include said interfacing means further comprising complimentingly different corresponding pairs of raceways being an outside interface raceway pair and an inside interface raceway pair, said outside interface raceway pair comprising a raceway on said axial hollow interior core of said housing and said exterior surface of said piston sleeve, said inside interface raceway pair comprising a raceway on said axial hollow interior core of said piston sleeve and said exterior surface of said drive shaft, and two interface pairs comprising said piston sleeve and said housing, and said drive shaft and said piston sleeve, each of said outside interface raceway pair and said inside interface raceway pair adapted to either of permitting lateral motion while prohibiting rotational motion and permitting lateral motion directly related to rotational motion, between respective said interface pair. Other variations of this embodiment include a first said complimentingly different corresponding pair of raceways comprising a fixed point raceway and a circumferential raceway having radiuses and ramps, and a second said complimentingly different corresponding pair of raceways comprising at least one linear raceway. Other variations of this embodiment include said valving means for directing said fluid flow to said piston sleeve opposing crowns being a valve system at each said opposing end of each said piston sleeve.

In another embodiment, the device comprises transitioning between fluid power and torque comprising applying pressure to at least one piston sleeve to induce both lateral and rotational motion in each said piston sleeve, each of said piston sleeves operatively connected to a drive shaft and a housing such that one of said drive shaft and said housing rotates with each said piston sleeve in relation to the other of said drive shaft and said housing. Other variations of this embodiment include coordinating the application of pressure step with a valve system operatively connected with each of said piston sleeves, said drive shaft, said housing, said inlet flow passages and said outlet flow passages to coordinate alternatingly sequenced fluid communication of said portions of said fluid flow to and from each pair of piston crowns. Other variations of this embodiment include altering the rotational relationship between said drive shaft and said housing by modifying a configuration of a circumferential raceway having radiuses and ramps. Other variations of this embodiment include said pressure to said at least one piston sleeve is rotational pressure through either of said drive shaft and said housing. Other variations of this embodiment include said pressure to said at least one piston sleeve is fluid pressure alternatingly applied to each piston crown of said pair of piston crowns.

The foregoing disclosure and description of the invention is illustrative and explanatory thereof, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

I claim:

1. An apparatus for transitioning between fluid power and torque using a fluid flow, said apparatus comprising:

at least two piston sleeves, a drive shaft, a housing, inlet passageways, outlet passageways, and a valve system;

said piston sleeve and said valve system intermediate and operatively connected to said drive shaft and said housing, each said piston sleeve having opposing ends;

a first interface between said drive shaft and each said piston sleeve and a second interface between said housing and each said piston sleeve, said first interface and said second interface being each a different one of either of a linear interface and a combination interface such that linear motion in said piston sleeve results in rotation of said drive shaft relative to said housing;

said inlet passageways and said outlet passageways capable of supporting portions of said fluid flow; and said valve system operative to coordinate intermittent flow of said portions of said fluid flow within each of said inlet passageway and each said outlet passageway such that said inlet passageways and said outlet passageways become alternatingly accessible to said opposing ends of each said piston sleeve.

2. The apparatus of claim 1, further comprising:

said linear interface having a linear roller set and a linear pair of opposing raceways; and said combination interface having a combination roller set and a combination pair of opposing raceways, said combination pair of opposing raceways comprising a fixed point raceway and a circumferential raceway having radiuses and ramps.

3. The apparatus of claim 2, further comprising:

a configuration of said circumferential raceway having radiuses and ramps determinative of said apparatus' operational performance.

4. The apparatus of claim 1, further comprising:

one of said drive shaft and said housing attachable to a pressurize fluid supply and the other attachable to a rotary tool.

5. The apparatus of claim 1, further comprising:

one of said drive shaft and said housing attachable to a rotary power supply and the other in fluid communication with a fluid supply.

6. The apparatus of claim 1, further comprising:

said drive shaft having an interior for supporting fluid flow.

7. A fluid motor for manipulating a fluid, said motor comprising:

a housing, said housing having an exterior surface, and an axial hollow interior core;

at least two piston sleeves, said piston sleeves generally cylindrical in shape, having an exterior surface and an axial hollow interior core, each said piston sleeve coaxially positioned within said hollow interior core of said housing, each said piston sleeve having opposing piston crowns;

a drive shaft, said drive shaft generally cylindrical in shape, having an exterior surface and an axial hollow interior core capable of supporting a fluid flow, said drive shaft coaxially positioned within said hollow interior core of said piston sleeve;

each said piston sleeve capable of both lateral and rotational motion, said lateral and rotational motion of said piston sleeve directly related, said piston sleeve operatively connected to said drive shaft and said housing such that one of said drive shaft and said housing rotates with said piston sleeve in relation to the other of said drive shaft and said housing;

said inlet and outlet passages, each capable of supporting portions of said fluid flow to coordinatedly provide fluid communication to and from each of said piston crowns; and a valve system operatively connected with each of said piston sleeves, said drive shaft, said housing, said inlet flow passages and said outlet flow passages to coordinate alternatingly sequenced fluid communication of said portions of said fluid flow to and from each of said piston crowns.

8. The fluid motor of claim 7 further comprising:

said inlet and outlet passages, each capable of alternatingly providing fluid communication to and from each of said piston crowns.

9. The fluid motor of claim 7 further comprising:

complimentingly different corresponding pairs of raceways being an outside interface raceway pair and an inside interface raceway pair;

said outside interface raceway pair comprising a raceway on said axial hollow interior core of said housing and said exterior surface of said sleeve piston;

said inside interface raceway pair comprising a raceway on said axial hollow interior core of said sleeve piston and said exterior surface of said drive shaft; and two interface pairs comprising said piston sleeve and said housing, and said drive shaft and said piston sleeve;

each of said outside interface raceway pair and said inside interface raceway pair adapted to either of permitting lateral motion while prohibiting rotational motion and permitting lateral motion directly related to rotational motion, between respective said interface pair.

10. The device of claim 9 further comprising:

a first said complimentingly different corresponding pair of raceways comprising a fixed point raceway and a circumferential raceway having radiuses and ramps; and a second said complimentingly different corresponding pair of raceways comprising at least one linear raceway.

11. The apparatus of claim 7, further comprising:

one of said drive shaft and said housing attachable to a pressurize fluid supply and the other attachable to a rotary tool.

12. The apparatus of claim 7, further comprising:

one of said drive shaft and said housing attachable to a rotary power supply and the other in fluid communication with a fluid supply.

13. An apparatus for transitioning between fluid power and torque using a fluid flow, said apparatus comprising:

at least two piston sleeves, a drive shaft, a housing, inlet passageways, outlet passageways, and a means for valving said inlet and outlet passageways;

said piston sleeves and said valve system intermediate and operatively connected to said drive shaft and said housing;

a means for interfacing said piston sleeves with said drive shaft and said housing, said interfacing means providing a direct relationship between linear motion in said piston sleeves and rotation of said drive shaft relative to said housing;

said inlet passageways and said outlet passageways capable of supporting portions of said fluid flow; and said valving means operative to coordinate intermittent flow of said portions of said fluid flow within each of said inlet and said outlet passageways such that said inlet passageways and said outlet passageways become alternatingly accessible to opposing ends of each said piston sleeve.

14. The device of claim 13 wherein said interfacing means further comprising:

complimentingly different corresponding pairs of raceways being an outside interface raceway pair and an inside interface raceway pair;

said outside interface raceway pair comprising a raceway on said axial hollow interior core of said housing and said exterior surface of said piston sleeve;

said inside interface raceway pair comprising a raceway on said axial hollow interior core of said piston sleeve and said exterior surface of said drive shaft; and two interface pairs comprising said piston sleeve and said housing, and said drive shaft and said piston sleeve;

each of said outside interface raceway pair and said inside interface raceway pair adapted to either of permitting lateral motion while prohibiting rotational motion and permitting lateral motion directly related to rotational motion, between respective said interface pair.

15. The device of claim 14 further comprising:

a first said complimentingly different corresponding pair of raceways comprising a fixed point raceway and a circumferential raceway having radiuses and ramps; and a second said complimentingly different corresponding pair of raceways comprising at least one linear raceway.

16. The device of claim 13 further comprising:

said valving means for directing said fluid flow to said piston sleeve opposing crowns being a valve system at each said opposing end of each said piston sleeve.

17. A method for transitioning between fluid power and torque comprising:

applying pressure to at least two piston sleeves to induce both lateral and rotational motion in each said piston sleeve, and each of said piston sleeves operatively connected to a drive shaft and a housing such that one of said drive shaft and said housing rotates with each said piston sleeve in relation to the other of said drive shaft and said housing through greater than one revolution.

18. Said method of claim 17, further comprising:

coordinating the application of pressure step with a valve system operatively connected with each of said piston sleeves, said drive shaft, said housing, said inlet flow passages and said outlet flow passages to coordinate alternatingly sequenced fluid communication of said portions of said fluid flow to and from each pair of piston crowns.

19. Said method of claim 17, further comprising:

altering the rotational relationship between said drive shaft and said housing by modifying a configuration of a circumferential raceway having radiuses and ramps.

20. Said method of claim 17, wherein:

said pressure to said at least two piston sleeves is rotational pressure through either of said drive shaft and said housing.

21. Said method of claim 17, wherein:

said pressure to said at least two piston sleeves is fluid pressure alternatingly applied to each piston crown of said pair of piston crowns.

* * * * *